US007433622B2

(12) United States Patent
Chadani et al.

(10) Patent No.: US 7,433,622 B2
(45) Date of Patent: Oct. 7, 2008

(54) PROCESS CARTRIDGE AND ELECTROPHOTOGRAPHIC IMAGE FORMING APPARATUS

(75) Inventors: Kazuo Chadani, Nagaizumicho (JP); Tamotsu Kaneko, Nagaizumicho (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/678,409

(22) Filed: Feb. 23, 2007

(65) Prior Publication Data

US 2007/0141889 A1 Jun. 21, 2007

Related U.S. Application Data

(62) Division of application No. 10/998,748, filed on Nov. 30, 2004, now Pat. No. 7,184,682.

(30) Foreign Application Priority Data

Jul. 30, 2004 (JP) ..... 2004-223778
Nov. 15, 2004 (JP) ..... 2004-330449

(51) Int. Cl.
*G03G 15/00* (2006.01)
*G03G 21/18* (2006.01)

(52) U.S. Cl. ..... 399/90; 399/111

(58) Field of Classification Search ..... 399/111, 399/113, 110, 90
See application file for complete search history.

(56) References Cited

U.S. PATENT DOCUMENTS 5,675,893 A 10/1997 Yamada et al. ..... 29/895.22
5,907,750 A 5/1999 Yamada et al. ..... 399/116
5,937,239 A 8/1999 Watanabe et al. ..... 399/111
5,943,529 A 8/1999 Miyabe et al. ..... 399/111
5,966,567 A 10/1999 Matsuzaki et al. ..... 399/111
6,144,815 A 11/2000 Chadani et al. ..... 399/27
6,173,140 B1 1/2001 Suzuki et al. ..... 399/113

(Continued)

FOREIGN PATENT DOCUMENTS

JP 3-60774 U 6/1991

(Continued)

OTHER PUBLICATIONS

Feb. 6, 2007 Japanese Office Action in Application No. 2004-330449.

*Primary Examiner*—Sophia S Chen
(74) *Attorney, Agent, or Firm*—Fitzpatrick, Cella, Harper & Scinto

(57) ABSTRACT

A process cartridge is detachably mountable to an electrophotographic image forming apparatus main assembly. The main assembly includes a main assembly electrical contact, first and second projections, main assembly positioning portions, and a force application member. The cartridge includes first and second frames, a first-frame drum, first and second portions, a second-frame developing roller, a second-frame force receiving portion, a regulating portion, a first-frame memory, a cartridge electrical contact, and a first-frame recess and a second-frame recess. When the cartridge is set in the main assembly, the cartridge electrical contact moves integrally with the main assembly electrical contact by the first frame recess engaging the first main assembly projection and the second frame recess engaging the second main assembly projection, upon the first frame rotating about the first portion and the second portion by the force receiving portion receiving the force from the force application member.

8 Claims, 12 Drawing Sheets

U.S. PATENT DOCUMENTS

| | | | | |
|---|---|---|---|---|
| 6,173,145 | B1 | 1/2001 | Chadani et al. | 399/265 |
| 6,178,302 | B1 | 1/2001 | Nagashima et al. | 399/106 |
| 6,205,305 | B1 | 3/2001 | Suzuki et al. | 399/106 |
| 6,219,504 | B1 | 4/2001 | Matsuzaki et al. | 399/92 |
| 6,282,389 | B1 | 8/2001 | Matsuzaki et al. | 399/111 |
| 6,301,457 | B1 | 10/2001 | Chadani et al. | 399/167 |
| 6,473,585 | B2 | 10/2002 | Abe et al. | 399/254 |
| 6,512,903 | B2 | 1/2003 | Chadani | 399/106 |
| 6,535,699 | B1 | 3/2003 | Abe et al. | 399/27 |
| 6,671,474 | B2 | 12/2003 | Chadani | 399/106 |
| 6,795,666 | B2 | 9/2004 | Miyabe et al. | 399/109 |
| 6,795,671 | B2 | 9/2004 | Matsuoka | 399/223 |
| 6,823,155 | B2 | 11/2004 | Tsuda et al. | 399/111 |
| 6,898,392 | B2 | 5/2005 | Karakama et al. | 399/90 |
| 6,922,534 | B2 | 7/2005 | Goto et al. | 399/90 |
| 6,931,226 | B2 | 8/2005 | Chadani et al. | 399/109 |
| 6,934,485 | B2 | 8/2005 | Miyabe et al. | 399/90 |
| 6,980,759 | B2 | 12/2005 | Kanno et al. | 399/111 |
| 7,027,754 | B2 | 4/2006 | Harada et al. | 399/111 |
| 7,058,337 | B2 | 6/2006 | Hashimoto et al. | 399/111 |
| 7,072,603 | B2 | 7/2006 | Tsuzuki et al. | 399/111 |
| 7,136,604 | B2 | 11/2006 | Chadani et al. | 399/90 |
| 7,162,174 | B2 | 1/2007 | Suzuki et al. | 399/64 |

FOREIGN PATENT DOCUMENTS

| | | |
|---|---|---|
| JP | 09-179476 | 7/1997 |
| JP | 2003-195720 | 7/2003 |
| JP | 2003-208775 | 7/2003 |
| JP | 2003-215876 | 7/2003 |

PROCESS CARTRIDGE AND ELECTROPHOTOGRAPHIC IMAGE FORMING APPARATUS

CROSS-REFERENCE TO RELATED APPLICATION:

The present application is a Divisional Application of U.S. application Ser. No. 10/998,748 filed Nov. 30, 2004, issued as U.S. Pat. No. 7,184,682 on Feb. 27, 2007.

FIELD OF THE INVENTION AND RELATED ART

The present invention is related to a process cartridge, and an electrophotographic image forming apparatus employing a process cartridge.

In the field of an electrophotographic image forming apparatus employing an electrophotographic image formation process, it is common practice to employ a process cartridge system, in which an electrophotographic photosensitive member, and one or more processing means, which act on the electrophotographic photosensitive member, are integrally placed in a cartridge removably mountable in the main assembly of an image forming apparatus.

A process cartridge system makes it possible for a user to maintain an image forming apparatus by himself without relying on a service person, drastically improving operational efficiency. Thus, a process cartridge is widely used in the field of an electrophotographic image forming apparatus.

A process cartridge is provided with an IC memory or the like in which the information to be transmitted to the main assembly of an image forming apparatus is stored, so that as the process cartridge is mounted into the main assembly, the information can be exchanged between the process cartridge and main assembly. Further, it has been proposed to make it possible for the information regarding the state of a process cartridge, history of its usage, etc., to be communicated to the control portion of the main assembly (U.S. Pat. No. 5,937,239).

In the memory of a process cartridge, such information as the lot number of the cartridge, properties of an image forming apparatus, properties of the processing means, etc., are stored, making it easier to maintain the main assembly of an image forming apparatus and/or a process cartridge. Further, it is possible to control an image forming process according to the information stored in the memory, so that images are formed under the optimal condition.

An image forming apparatus and a process cartridge are provided with a connective means for establishing an electrical connection between the memory of the process cartridge and the main assembly of the image forming apparatus. As such a connective means, a plain connector, a connector employing a springy member with a contact point, and the like, have been well known, because they are simple in structure, and advantageous in terms of cost. According to one of the connective systems employing a springy member, a process cartridge is provided with a connective portion for ensuring that an electrical connection is reliably established and maintained between the process cartridge and the main assembly of an image forming apparatus. More specifically, the process cartridge is provided with a connective portion, which guides the supportive member of the main assembly of an image forming apparatus, which supports the connective portion of the main assembly (U.S. Laid-open Patent Application 2003-0,123,896).

The present invention is the result of the further development of the above-described prior art.

SUMMARY OF THE INVENTION

The primary object of the present invention is to provide a combination of a process cartridge and an electrophotographic image forming apparatus, which is superior to a combination of a process cartridge and an electrophotographic image forming apparatus in accordance with the prior art, in terms of the reliability with which an electrical connection is established and maintained between the electrical contact of the process cartridge and the electrical contact of the main assembly of the image forming apparatus, as the process cartridge is mounted into the main assembly.

Another object of the present invention is to provide a combination of a process cartridge and an electrophotographic image forming apparatus, which is superior to a combination of a process cartridge and an electrophotographic image forming apparatus in accordance with the prior art, not only in terms of the reliability with which an electrical connection is established and maintained between the electrical contact of the process cartridge and the electrical contact of the main assembly of the image forming apparatus, as the process cartridge is mounted into the main assembly, but also, in terms of the ease with which the process cartridge is mountable into the main assembly.

Another object of the present invention is to provide a combination of a process cartridge and an electrophotographic image forming apparatus, in which the electrical contacts of the process cartridge and the electrical contacts of the main assembly of the image forming apparatus do not slide on each other, when the first frame of the process cartridge is rotated about the first and second positioning portions, which are precisely positioned to precisely position the process cartridge relative to the main assembly, in the main assembly.

Another object of the present invention is to provide a process cartridge, which is removably mountable in the main assembly of an electrophotographic image forming apparatus comprising: electrical contacts; first and second projections; a supporting member movable while supporting the electrical contacts and first and second projections; force applying members; and first and second cartridge positioning members. The cartridge comprises: a first frame; a second frame rotatably connected to the first frame; an electrophotographic photosensitive drum disposed in the first frame; a first positioning portion, which is precisely positioned to precisely position the process cartridge relative to the main assembly, and which projects outward from one of the lengthwise ends of the first frame, in terms of a direction parallel to the axial line of the photosensitive drum, in alignment with the photosensitive drum; a second cartridge positioning portion, which is precisely positioned by the second positioning portion of the main assembly to precisely position the process cartridge relative to the main assembly, and which projects outward from the other lengthwise end of the first frame, in terms of the direction parallel to the axial line of the photosensitive drum, in alignment with the photosensitive drum; a development roller disposed in the second frame to be placed in contact with the electrophotographic photosensitive drum to develop the electrostatic latent image formed on the electrophotographic photosensitive drum; a pair of force receiving portions, with which the second frame is provided, for receiving the force applied by the force applying members of the main assembly to separate the development roller from the electrophotographic photosensitive drum; a pair of rotation regulating portions, with which the first frame is provided, for regulating the rotation of the first frame about the first and second positioning portion, which is precisely positioned to precisely position the process cartridge relative to the main assembly, when the force receiving portion receives the force from one of the force applying members; a memory which is attached to the leading end of the first frame, in terms of the direction in which the process cartridge is mounted into the main assembly, and which is for storing information regarding the process cartridge; electrical contacts which are to be electrically connected to the electrical contacts of the main assembly, in order to allow the information in the memory to be transmitted to the main assembly, when the process cartridge is in the main assembly; a first recess, with which the first frame is provided, and into which the first projection of the supporting member of the main assembly fits to precisely position the electrical contacts of the process cartridge relative to the electrical contacts of the main assembly, as the process cartridge is mounted into the main assembly; a second recess, with which the first frame is provided, and into which the second projection of the supporting member of the main assembly fits to precisely position the electrical contacts of the process cartridge relative to the electrical contacts of the main assembly, as the process cartridge is mounted into the main assembly, wherein as the first frame is rotated about the first and second positioning portion, which are precisely positioned to precisely position the process cartridge relative to the main assembly, by the force applied to the force receiving portion of the first frame by the force applying members of the main assembly in order to separate the development roller from the electrophotographic photosensitive member, when the process cartridge is in the main assembly, the electrical contacts of the process cartridge move with the electrical contacts of the main assembly, because the first projection of the main assembly fits into the first recess of the process cartridge, and the second projection of the main assembly fits into the second recess of the process cartridge, and to provide an electrophotographic image forming apparatus compatible with such a process cartridge.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the process cartridge in one of the preferred embodiments of the present invention, and the electrophotographic image forming apparatus employing the process cartridge, will be described with reference to the appended drawings.

Embodiment 1

(General Structure of Electrophotographic Image Forming Apparatus)

Figure 1:
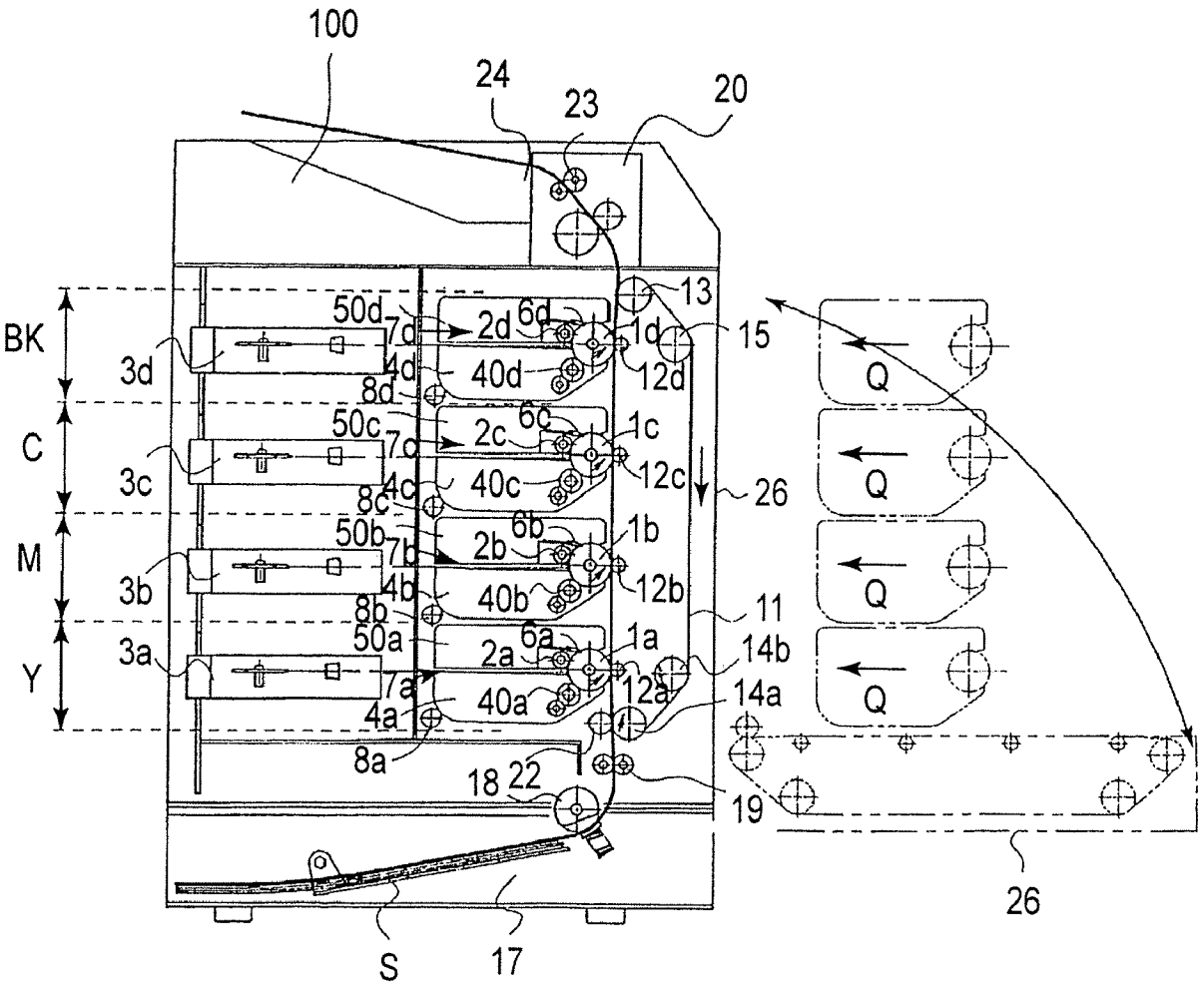
FIG. 1 is a sectional view of the electrophotographic image forming apparatus of the first embodiment of the present invention, showing the general structure thereof.

First, the general structure of an electrophotographic image forming apparatus will be briefly described. FIG. 1 is a sectional view of the electrophotographic image forming apparatus (which hereinafter may be referred to simply as the "image forming apparatus") in the first embodiment of the present invention. The image forming apparatus in this embodiment is a full-color laser beam printer, which employs one of the electrophotographic processes. It is an image forming apparatus of a transfer type, and also, of a tandem type.

In FIG. 1, reference symbols Y, M, C, and Bk stand for the first to fourth image formation stations, in which four images are formed of yellow, magenta, cyan, and black developers, respectively, which correspond to the color components into which the optical image of a full-color image is separable. The image formation stations Y, M, C, and Bk are located in the main assembly 100 of the image forming apparatus, being vertically aligned in the listed order, with the image formation station Y located at the bottom.

Each of the image formation stations Y, M, C, and Bk comprises: an electrophotographic photosensitive drum 1 (1*a*, 1*b*, 1*c*, and 1*d*), and such electrophotographic processing means as a charging means 2 (2*a*, 2*b*, 2*c*, and 2*d*) for uniformly charging the peripheral surface of the photosensitive drum 1, a developing means 4 (4*a*, 4*b*, 4*c*, and 4*d*) for developing the latent image formed on the peripheral surface of the photosensitive drum 1 into a visible image with the use of developer, and a cleaning means 6 (6*a*, 6*b*, 6*c*, and 6*d*) for removing the developer remaining on the peripheral surface of the photosensitive drum 1 after the transfer of the developer image on the peripheral surface of the photosensitive drum 1 onto a recording medium. The processing means are disposed in the adjacencies of the peripheral surface of the photosensitive drum 1. In this embodiment, the photosensitive drum 1, the charging means 2, the developing means 4, and the cleaning means 6 are integrally disposed in a process cartridge 7, which will be described later.

The main assembly of the image forming apparatus is provided with scanner units 3 (3*a*, 3*b*, 3*c*, and 3*d*), each of which is for forming a latent image on the peripheral surface of the corresponding photosensitive drum 1 by selectively exposing numerous points of the uniformly charged peripheral surface of the photosensitive drum 1, based on the image formation data. The scanner units 3 are located in the rear portion of the main assembly.

The main assembly is also provided with a cassette 17, in which recording media S are stored. The cassette 17 is located in the bottom portion of the main assembly. Also located in the bottom portion of the main assembly is a recording medium conveying means which conveys the recording medium S upward of the main assembly to make each recording medium S move past the photosensitive drum 1 while remaining in contact with the peripheral surface of the photosensitive drum 1; in other words, the main assembly is provided with a feed roller 18 which feeds the recording media S, one by one, into the main assembly, and a pair of registration rollers 19. Located above the cassette 17 is a transfer belt 11, which is wrapped around four rollers, that is, a driving roller 13, a pair of follower rollers 14*a* and 14*b*, and a tension roller 15, being suspended by the rollers, and is circularly moved so that it remains in contact with all of the photosensitive drums 1. The transfer belt 11 conveys the recording medium S upward while keeping the recording medium S electrostatically adhered thereto with the application of voltage to the transfer belt 11 and an electrostatic adhesion roller 22.

The image forming process carried out by this image forming apparatus is as follows.

Each photosensitive drum 1 is rotated. As it is rotated, its peripheral surface is uniformly charged by the charging means 2. Then, the numerous points of the uniformly charged peripheral surface of the photosensitive drum 1 are selectively exposed by the scanner unit 3. As a result, an electrostatic latent image is formed on the peripheral surface of the photosensitive drum 1. This electrostatic latent image is developed by the developing means 4, into a visible image formed of developer. Since there are four photosensitive drums 1, four developer images different in color are formed on the four photosensitive drums 1, one for one. Meanwhile, in synchronism with the formation of the four developer images, the recording medium S is conveyed by the recording medium conveying means to each of the four positions, where the recording medium S is placed in contact with the peripheral surface of the photosensitive drum 1. Then, while the recording medium S is conveyed in contact with the peripheral surface of the photosensitive drum 1, transfer bias is applied to a transfer roller (12*a*, 12*b*, 12*c*, and 12*d*), which is kept pressed against the photosensitive drum 1 with the transfer belt 11 (and recording sheet S) sandwiched between the transfer roller and the photosensitive drum 1. As a result, the developer images, different in color, on the photosensitive drums 1 are transferred in layers onto the recording medium S, forming thereby a color image on the recording medium S.

Next, the recording medium S bearing the color image formed through the above described steps is subjected to heat and pressure by a fixing portion 20. As a result, the color image formed of the developers is fixed. Thereafter, the recording medium S is discharged into a delivery tray 24 by a pair of discharge rollers 23. The fixing portion 20 is in the top portion of the main assembly.

After the transfer of the developer images onto the recording medium S, residues such as the developer remaining on the peripheral surface of the photosensitive drum 1 in each of the first to fourth image formation stations Y, M, C, and Bk are removed by the cleaning means 6, so that the photosensitive drum 1 can be repeatedly used for image formation.

(Process Cartridge)

The photosensitive drum 1, the charging means 2, the developing means 4, and the cleaning means 6 in each of the first to fourth image formation stations Y, M, C, and Bk are in the process cartridge 7 (7*a*, 7*b*, 7*c*, and 7*d*), which is removably mounted in the main assembly 100 of the image forming apparatus.

Next, the process cartridge (which hereinafter will be referred to simply as "cartridge") 7 will be described regarding its structure.

Referring to FIG. 1, the cartridge 7 in this embodiment comprises the photosensitive drum 1, the charging means 2, and a cleaning blade 6 as a cleaning means. It also comprises a first frame as the frame for a cleaning unit 50 (50*a*, 50*b*, 50*c*, and 50*d*), and a second frame for a development unit 4. The development unit 4 is attached to the cleaning unit 50, being enabled to pivot relative to the cleaning unit 50.

As for the procedure for mounting each of the cartridges 7 into the main assembly 100 of the image forming apparatus, or removing them therefrom, a hinged door 26 is to be widely opened to fully expose the opening 91 of the cartridge compartment of the main assembly 100, and then, the cartridges 7 are mounted into the main assembly 100, or removed therefrom. Obviously, the hinged door 26 is opened or closed relative to the main assembly 100. The hinged door 26 is attached to the front side of the main assembly.

Figure 8:
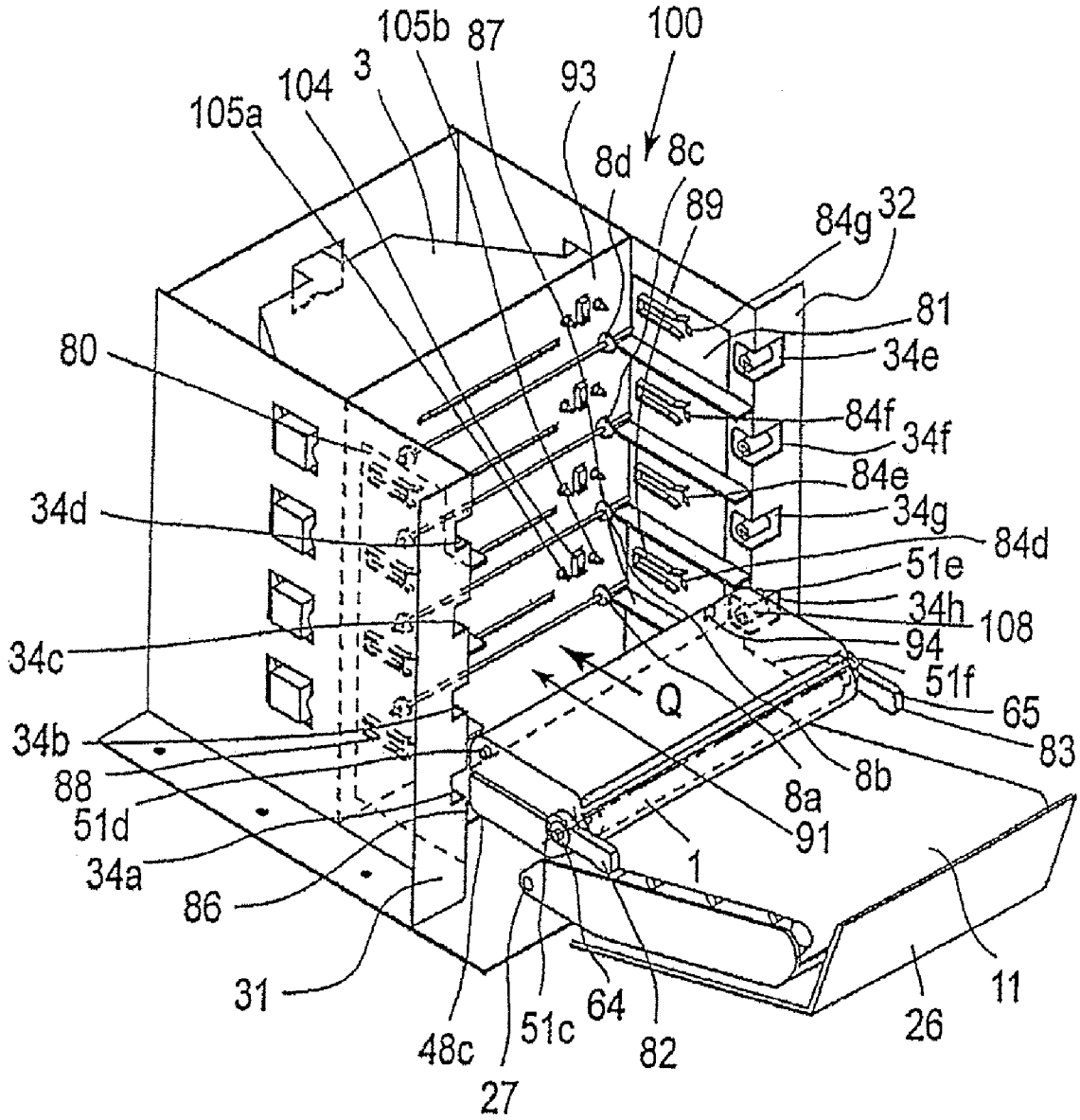
FIG. 8 is a perspective view of the main assembly of the image forming apparatus, showing the cartridge compartment thereof.

More specifically, referring to FIG. 8, the door 26 is rotatable frontward, as outlined by the double-dot chain line in FIG. 1, or by the solid line in FIG. 8, about the hinge shaft located at the bottom of the door 26. As the door 26 is rotationally pulled down frontward as described above, the aforementioned opening 91 is exposed (FIG. 8). On the other hand, as the door 26 is rotated in reverse, it is closed against the main assembly 100 (as outlined by solid line in FIG. 1). The door 26 constitutes a part of the front cover of the main assembly 100. The aforementioned transfer belt 11 is attached to the door 26, on the inward side.

The structure and mechanism involved with the mounting of the cartridge 7 into the main assembly 100, and removal of the cartridge 7 therefrom, will be described later in detail.

In the following descriptions of the preferred embodiment of the present invention, the widthwise direction of the cartridge 7 or the components thereof is the direction parallel to the direction in which the cartridge is mounted into, or removed from, the main assembly 100, whereas the lengthwise direction is the direction intersecting the direction in which the cartridge 7 is mounted into, or removed from, the main assembly. The back side of the cartridge 7 is the side of the cartridge 7, which will become the inward side of the cartridge 7 as it is mounted into the main assembly, and the left and right sides of the cartridge 7 are the sides which will become the left and right sides of the cartridge 7 as it is seen from the front side of the main assembly after it is mounted into the main assembly. Further, the top and bottom surfaces of the cartridge 7 are the surfaces of the cartridge 7, which will be facing upward and downward, respectively, after the cartridge 7 is properly mounted into the main assembly.

Figure 2:
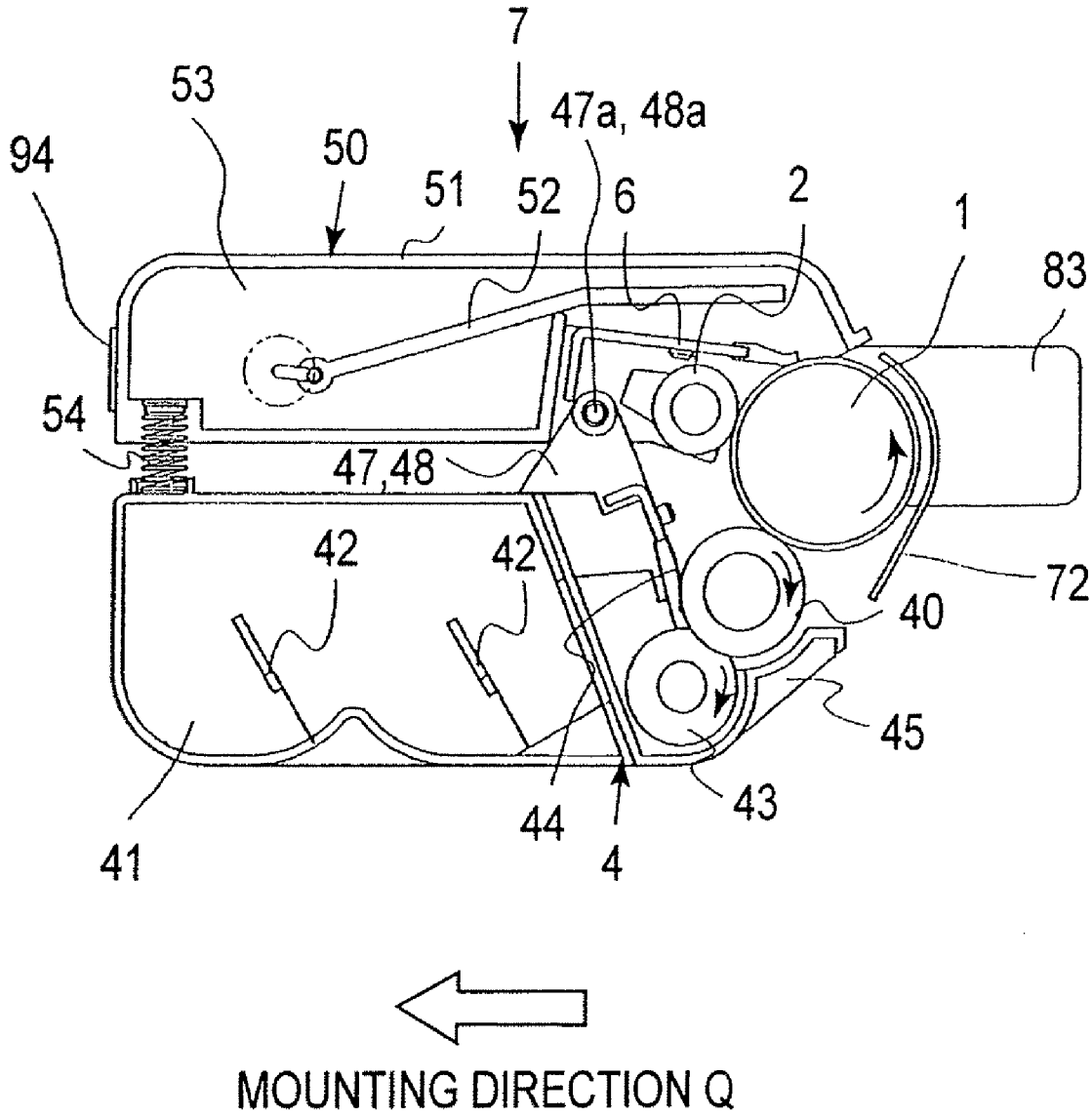
FIG. 2 is a sectional view of the cartridge in the first embodiment of the present invention.
Figure 3:
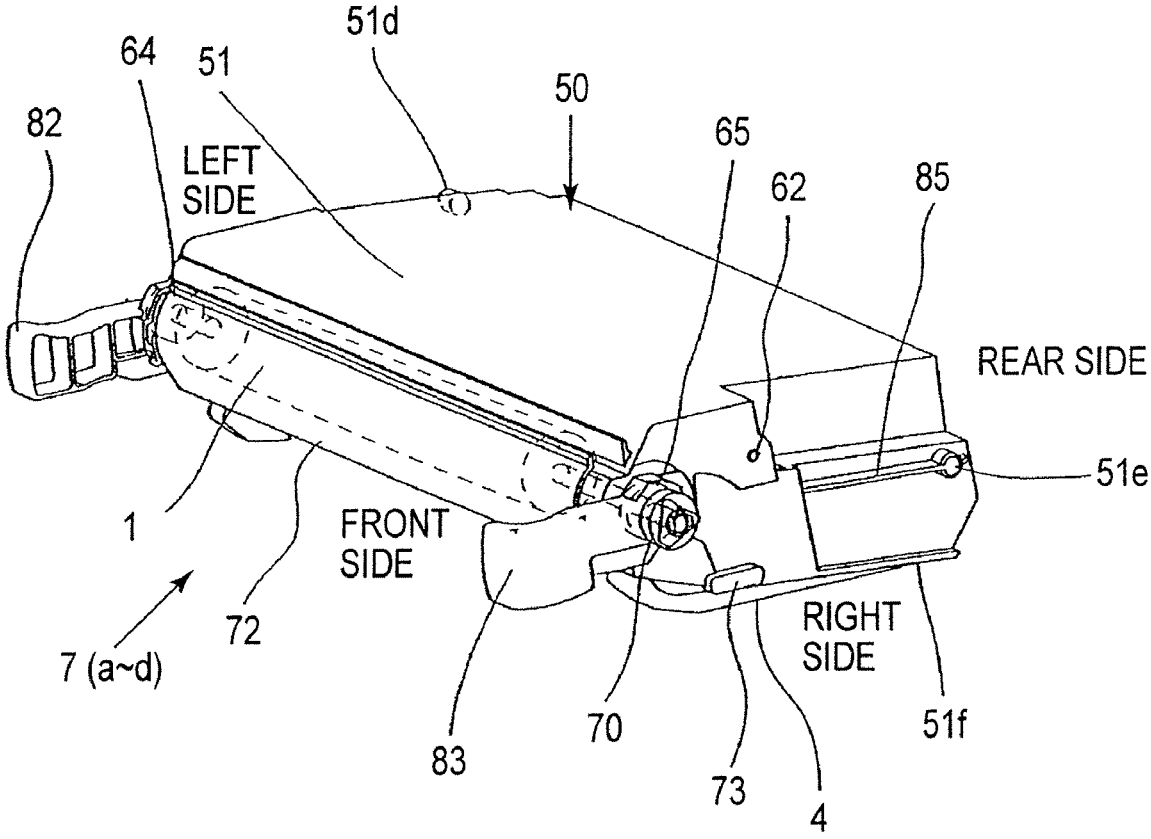
FIG. 3 is a schematic perspective view of the cartridge in the first embodiment of the present invention.
Figure 4:
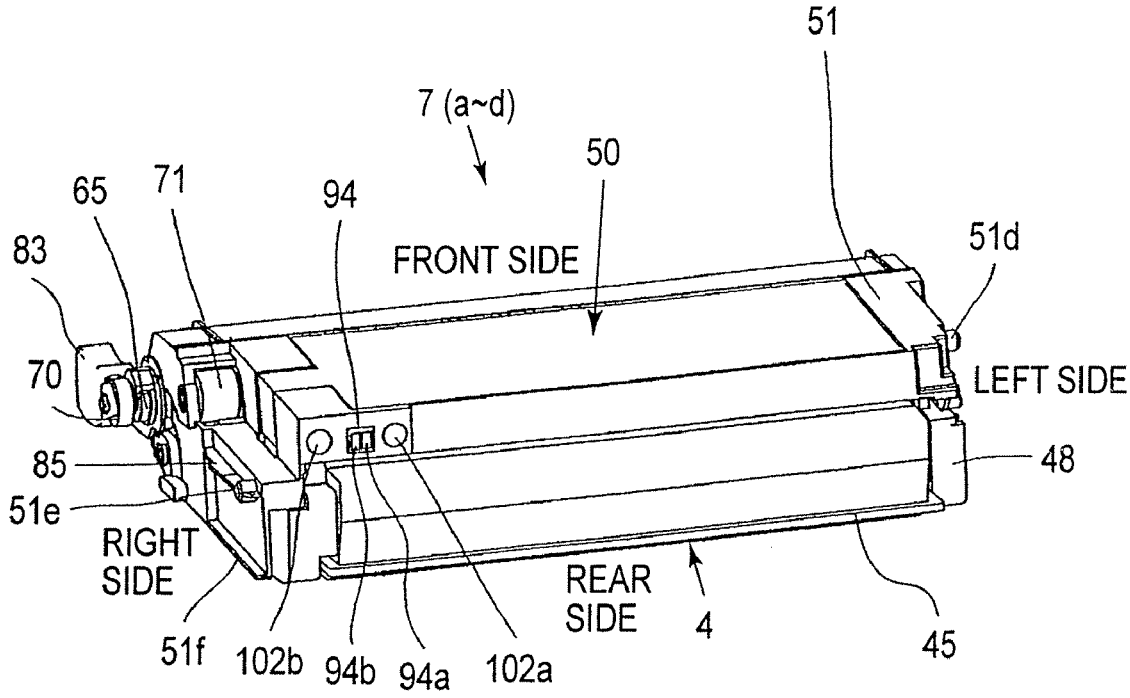
FIG. 4 is a schematic perspective view of the cartridge in the first embodiment of the present invention, as seen from the opposite side from which the cartridge is seen in FIG. 3.
Figure 5:
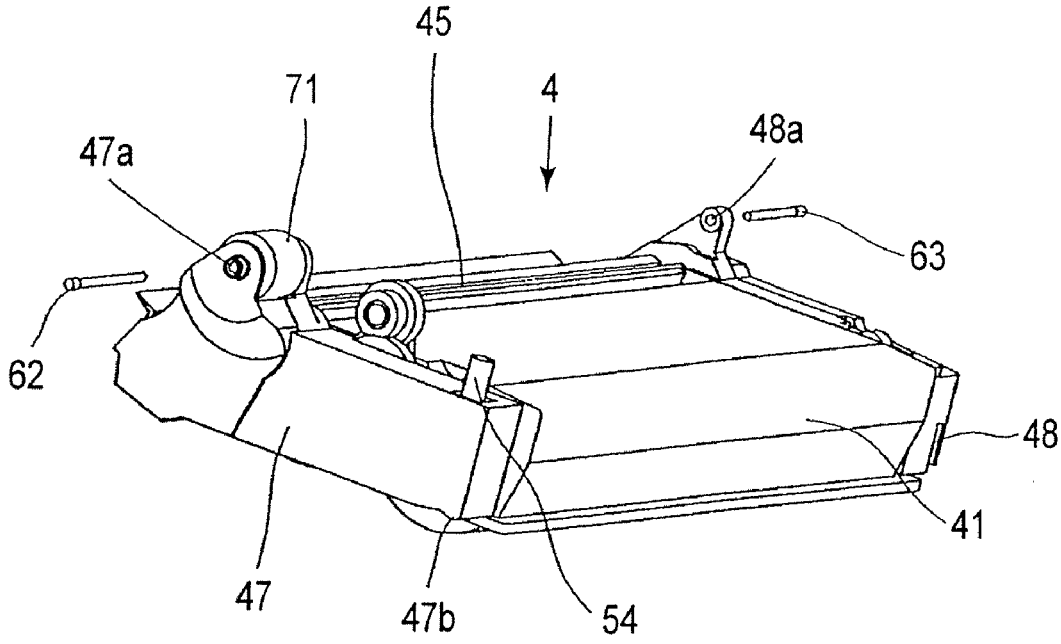
FIG. 5 is a schematic perspective view of the development unit of the cartridge.
Figure 6:
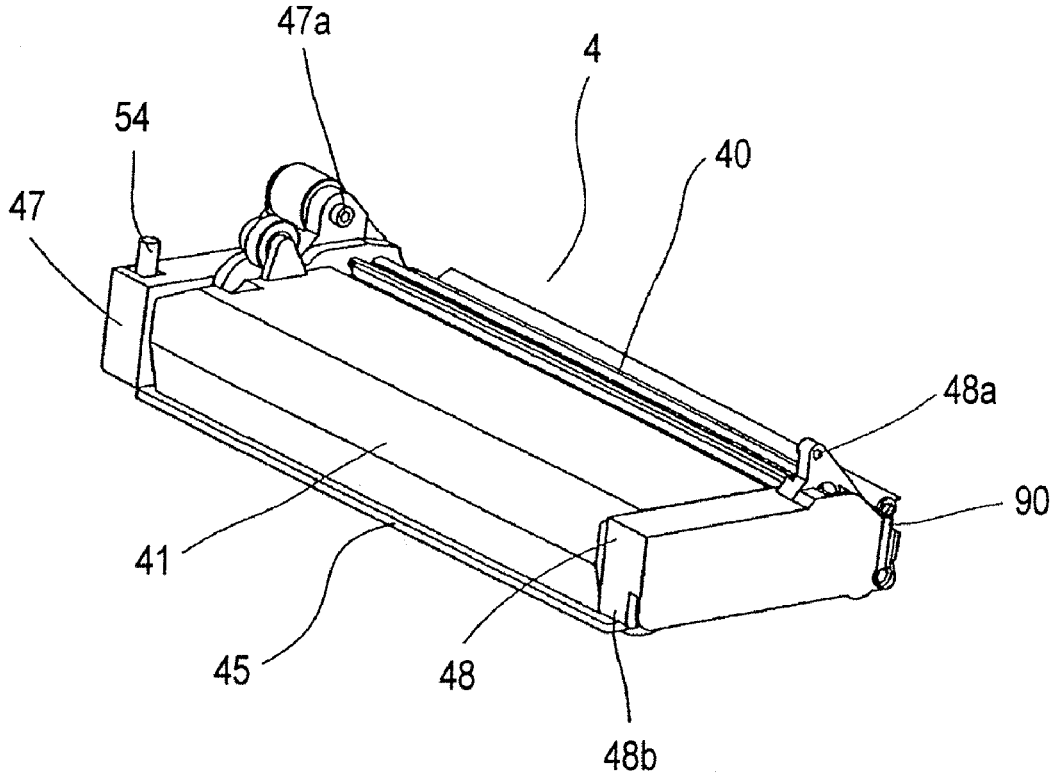
FIG. 6 is a schematic perspective view of the development unit shown in FIG. 5, as seen from the opposite side from the side from which the unit is seen in FIG. 6.
Figure 7:
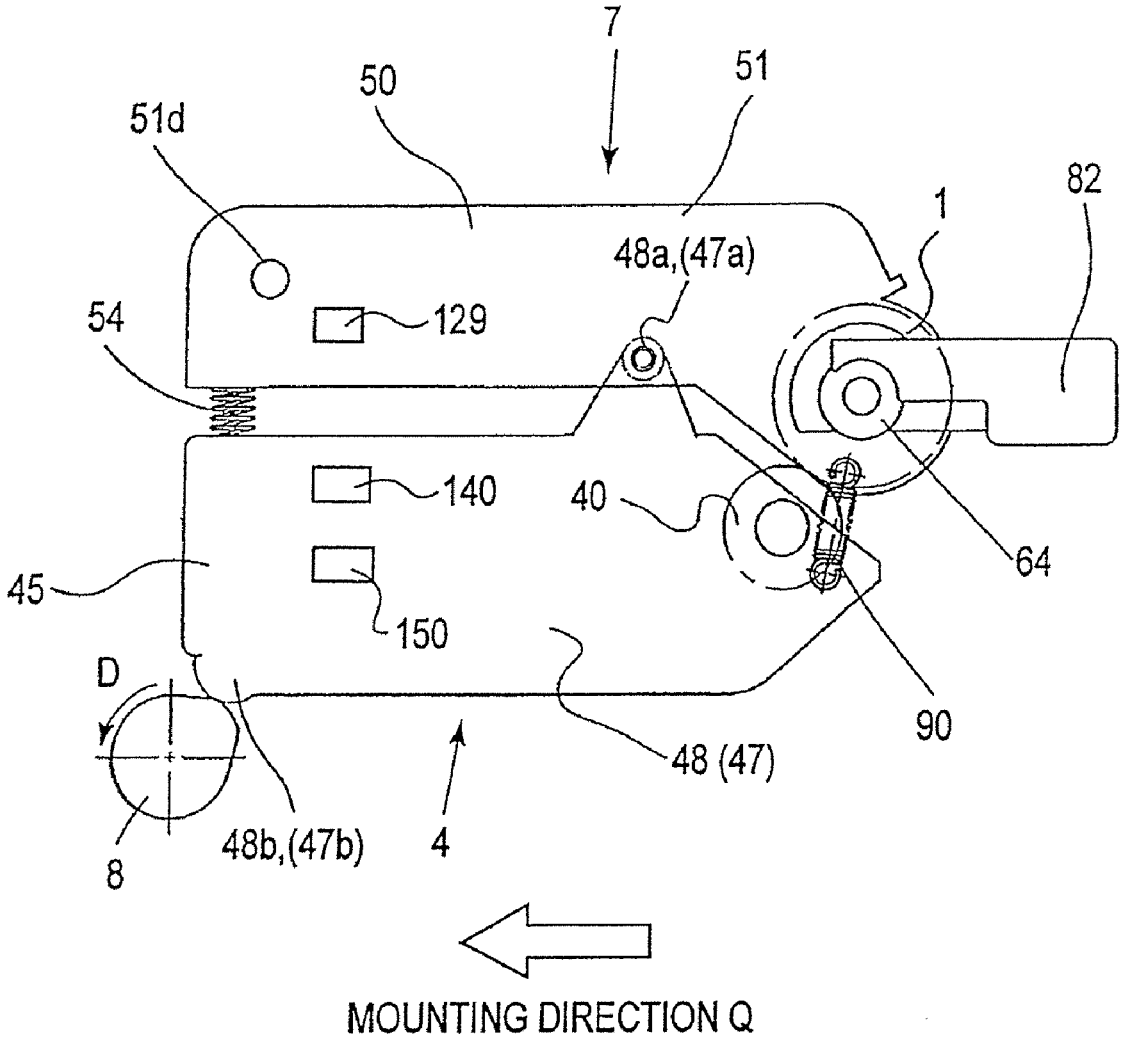
FIG. 7 is a phantom side view of the cartridge, showing the structural arrangement thereof for allowing the development unit to pivot.

FIG. 2 is a sectional view of the cartridge 7, and FIGS. 3 and 4 are schematic perspective views of the cartridge 7, different in the direction from which the cartridge 7 is viewed. FIGS. 5 and 6 are schematic perspective views of the development unit of the cartridge 7, different in the direction from which the unit is viewed. FIG. 7 is a phantom side view of the cartridge 7, showing the pivotal movement of the development unit.

Regarding the developer stored in the developer container of the developing means of the cartridge 7 in each of the image formation stations Y, M, C, and Bk, the developer stored in the cartridge 7*a* mounted in the first image formation station Y is yellow developer; the developer stored in the cartridge 7*b* mounted in the second image formation station M is magenta developer; the developer stored in the cartridge 7*c* mounted in the third image formation station C is cyan developer; and the developer stored in the cartridge 7*d* mounted in the fourth image formation station Bk is black developer. Although the four cartridges 7 are different in the color of the developers they store, they are identical in structure.

Each of the cartridges 7 in this embodiment is a combination of the aforementioned cleaning unit 50 and development unit 4, which are connected (hinged) to each other.

The cleaning unit 50 comprises the photosensitive drum 1, which is rotatably attached to the frame of the cleaning unit 50. The cleaning unit 50 also comprises the charging means 2, and the cleaning blade 6, which are disposed in the adjacencies of the peripheral surface of the photosensitive drum 1. The residual developer is removed from the peripheral surface of the photosensitive drum 1 by the cleaning blade 6, and is sent by a developer conveying mechanism 52 into a removed developer chamber 53 located in the rear portion of the cleaning means frame 51. The charging means 2 used in this embodiment employs the contact type charging method. More specifically, the charging means 2 is an electrically conductive roller (charge roller), and is placed in the peripheral surface of the photosensitive drum 1. As charge bias voltage is applied to this charge roller, the peripheral surface of the photosensitive drum 1 is uniformly charged.

The development unit 4 has a developer container 41 and a frame 45. The developer in the developer container 41 is moved by the developer conveying mechanism 42 to a developer supply roller 43. Then, it is coated on the peripheral surface of the development roller 40 (40*a*, 40*b*, 40*c*, and 40*d*) as a developing means by the developer supply roller 43, and a development blade 44 kept pressed upon the peripheral surface of the development roller 40, while being frictionally charged by the developer supply roller 43 and the blade 44. Then, as development bias is applied to the development roller 40 from the main assembly, the electrostatic latent image on the peripheral surface of the electrophotographic photosensitive drum 1 is developed; the development roller 40 is positioned so that its peripheral surface is placed in contact, or virtually in contact, with the peripheral surface of the photosensitive drum 1, in order to develop the electrostatic latent image on the peripheral surface of the photosensitive drum 1.

Referring to FIG. 3, the photosensitive drum 1 is rotatably supported by its lengthwise ends, by the frame 51 of the cleaning unit 50, with a pair of bearings 64 (first portion to be precisely positioned) and 65 (second portion to be precisely positioned) disposed between the lengthwise ends of the photosensitive drum 1 and the cleaning unit frame 51. The process cartridge 7 is provided with a coupling 70, which is attached to one of the lengthwise ends of the photosensitive drum 1, and to which a driving force is transmitted from the motor (unshown) provided on the main assembly side of the image forming apparatus. Through this coupling 70, the photosensitive drum 1 is rotationally driven in the counterclockwise direction (FIG. 2). The rotation of the photosensitive drum 1 is transmitted through a gear train (unshown) to the developer moving mechanism 52 in the removed developer chamber 53, driving thereby the developer moving mechanism 52.

The bearings 64 and 65 are supported by the handles 82 and 83, respectively, and the frame 51 of the cleaning unit 50. Incidentally, the handles 82 and 83 are to be used when the cartridge 7 is mounted into the main assembly 100. The cleaning unit frame 51 is provided with a shutter 72 for protecting the photosensitive drum 1. The shutter 72 is opened or closed by the movement of the cartridge 7 through the shutter moving member 73; as the cartridge 7 is inserted into the main assembly 100, the shutter 72 is opened, and as the cartridge 7 is extracted from the main assembly 100, the shutter 72 is closed.

The bearing 64 supports the photosensitive drum 1 at one end of the photosensitive drum 1 in terms of the axial direction of the photosensitive drum 1, whereas the bearing 65 supports the photosensitive drum 1 at the other end. The bearing 65 extends outward of the cleaning unit frame 51 in the axial direction of the photosensitive drum 1.

(Structural Arrangement for Allowing Development Unit to Pivotally Move)

The development unit 4 is attached to the cleaning unit 50 so that the entirety of the development unit 4 is allowed to rotationally move relative to the cleaning unit 50. More specifically, referring to FIGS. 5 and 6, the bearings 47 and 48 attached to the lengthwise ends of the development unit 4, one for one, are provided with holes 47*a* and 48*a*, respectively, the axial lines of which coincide with the axial line about which the development unit 4 rotates. Through these holes 47*a* and 48*a*, connective shafts 62 and 63 are inserted through the cleaning unit frame 51, attaching the development unit 4 to the cleaning unit frame 51 in a manner to allow the development unit 4 to rotate relative to the cleaning unit frame 51. When the cartridge 7 is out of the main assembly 100, the development roller 40 is kept in contact with the photosensitive drum 1 by the torque generated by an elastic means in a direction to rotate the development unit 4 about the connective shafts 62 and 63. More specifically, referring to FIGS. 6 and 7, as the elastic means for keeping the development roller 40 pressed upon the photosensitive drum 1, the cartridge 7 is provided with a compression spring 54 and a tension spring 90, which are disposed between the cleaning unit 50 and development unit 4. The compression spring 54 is located on the same side of the cartridge 7 as the bearing 47, and the tension spring 90 is located on the same side of the cartridge 7 as the bearing 48.

Referring to FIG. 7, in terms of the direction Q in which the cartridge 7 is inserted into the main assembly 100, the holes 47*a* and 48*a*, about the axial lines of which the development unit 4 is rotatable, are located between the development roller 40 and contact pressure receiving portions 47*b* (48*b*); they are located on the downstream side of the development roller 40.

With the development roller 40 and holes 47*a* and 48*a* positioned as described above, as the cartridge 7 is inserted into the main assembly 100, the contact pressure receiving portions 47*b* and 48*b* slide onto a pair of cams 8 (8*a*, 8*b*, 8*c*, and 8*d*) provided on the main assembly side. Thus, as the cartridge 7 is inserted into the main assembly, the development roller 40 and photosensitive drum 1 are separated from each other, and are kept separated, by this simple structural arrangement, until an image forming operation is started. As an image forming operation is started, the cams 8 as means for applying upward pressure to the cartridge 7 are rotated to eliminate the upward pressure applied by the cams 8. As a result, the development roller 40 is placed in contact with the photosensitive drum 1, and kept pressed thereupon, by the forces generated by the compression spring 54 and tension spring 90, readying the development roller 40 for supplying the photosensitive drum 1 with developer.

When the development roller 40 must be separated from the photosensitive drum 1, the cams 8 are to be rotated in the direction indicated by an arrow mark D in FIG. 7 to push up the contact pressure receiving portions 47*b* and 48*b* so that the peripheral surface of the development roller 40 is separated from the peripheral surface of the photosensitive drum 1 by a predetermined distance. The contact pressure receiving portions 47*b* and 48*b* are integral parts of the frame of the development unit 4.

The developing method employed in this embodiment is the contact development method, in which the development roller 40 is placed in contact with the photosensitive drum 1 to develop a latent image formed on the peripheral surface of the photosensitive drum 1. Thus, the photosensitive drum 1 is desired to be a rigid drum, whereas the development roller 40 is desired to be an elastic roller, for example, a plain roller formed of solid rubber, a solid rubber roller, the surface of which is coated with resin in consideration of the fact that the development roller 40 is required to charge developer, or the like rollers.

(Structure for Driving Force Transmission)

Referring to FIGS. 4 and 5, designated by a reference number 71 is a cartridge gear (helical gear) of the development unit 4, as a portion through which the driving force for rotating the development roller 40 is received from the main assembly 100 of the image forming apparatus. When the cartridge 7 is in the main assembly 100, the gear 71 remains meshed with the cartridge driving gear (unshown helical gear) on the main assembly side, to receive the driving force therefrom. As the gear 71 is rotated, the development roller 40, the developer conveying mechanism 42 and the developer supply roller 43 are driven through a gear train (unshown). The gear 71 is attached to one end of the development roller 40 in terms of the axial direction (lengthwise direction) of the photosensitive drum 1.

To one end of the rotational shaft of the photosensitive drum 1, a coupling 70 as a portion through which the driving force for driving the photosensitive drum 1 is received is attached. In other words, the coupling 70 is attached to one end of the photosensitive drum 1 in terms of the axial direction (lengthwise direction) of the photosensitive drum 1. When the cartridge 7 is in the main assembly 100, the coupling 70 remains engaged with the coupling (unshown) on the main assembly side, and receives the driving force from the coupling on the main assembly side to rotationally drive the photosensitive drum 1.

In terms of the lengthwise direction, the gear 71 and coupler 70 are located at the same end of the cartridge 7, that is, the end where the electrical contacts 94*a* and 94*b* on the cartridge side, which will be described later, are disposed.

(Storage Means)

The cartridge 7 in this embodiment is provided with a storage means for storing information regarding the lot number of a cartridge, properties of an image forming apparatus, properties of processing means, etc. The information stored in this storage means is exchanged between the storage means and main assembly 100 to inform the control portion (unshown) of the main assembly 100 of the current state, history, etc., of the cartridge 7, and the control portion controls the image forming process based on the thus obtained information. Therefore, images are formed under the optimal condition.

The storage means in this embodiment comprises a memory 130 (FIG. 11), electrical contacts 94*a* and 94*b*, and a memory board 94 on which the memory 130 and electrical contacts 94*a* and 94*b* are disposed. The memory board 94 is attached to the cleaning unit 50. The memory 130 is on one of the primary surfaces of the memory board 94, and stores various information regarding the cartridge 7. In other words, the information regarding the cartridge 7 remains in the memory 130.

The electrical contacts 94*a* and 94*b* are on the other primary surface of the memory board 94, and are placed in contact with the electrical contacts 103*a* and 103*b* on the main assembly side, an establishing electrical connection between the cartridge 7 and the main assembly 100, as the cartridge 7 is mounted into the main assembly 100. The information in the memory 130 is transmitted to the main assembly 100 through the electrical contacts 94*a* and 94*b*. The memory board 94 is solidly attached to the cleaning unit frame 51 by two-sided adhesive tape, hot melt, adhesive, thermal crimping, or the like so that the electrical contacts 94*a* and 94*b* are exposed from the cartridge shell.

One end of the cleaning unit 50 having the memory board 94 is provided with a pair of holes 102*a* and 102*b*, which are positioned in a manner to sandwich the electrical contacts 94*a* and 94*b* of the cartridge 7, in terms of the lengthwise direction. The two holes 102*a* and 102*b* constitute first and second positioning recesses for precisely positioning the electrical contacts 94*a* and 94*b* on the cartridge side relative to the electrical contacts 103*a* and 103*b* on the main assembly side, as the cartridge 7 is mounted into the main assembly 100. The first and second positioning holes 102*a* and 102*b* will be described later in more detail.

(Cartridge Compartment)

Next, referring to FIGS. 8 and 9, how the cartridge 7 is mounted into the main assembly 100 will be described.

Referring to FIG. 8, the operation for mounting each of the cartridges 7 into the main assembly 100, or removing them therefrom, is carried out with the door 26 wide open to fully expose the opening 91.

While the door 26 remains closed against the main assembly 100, it remains locked by a latching mechanism (unshown). With the latching mechanism released, the door 26 can be rotated frontward about the hinge shaft 27 to expose the opening 91. On the inward side of the opening 91, guides 80 and 81 are located, which are attached to the side walls 31 and 32, respectively, of the main assembly 100. The main assembly 100 is capable of accommodating four cartridges 7, which are to be inserted through the opening 91 to be vertically stacked. Also on the inward side of the opening 91, there are four cartridge bays for the cartridges for developing yellow, magenta, cyan, and black colors, one for one.

The four cartridge bays are identical in the structure for accommodating a cartridge. Therefore, how the cartridges 7 are mounted into the main assembly will be described with reference to the cartridge for developing yellow color, or the cartridge to be mounted into the bottommost cartridge bay.

First, an operator is to hold the cartridge 7 by gripping the handles 82 and 83 of the cartridge 7 located at the lengthwise ends of the cartridge 7, one for one, with the left and right hands, one for one, and to insert the cartridge into the main assembly 100 through the opening 91 in the direction indicated by an arrow mark Q, from the back side of the cartridge 7, that is, the opposite side from the photosensitive drum 1, in terms of the widthwise direction.

Each of the guides 80 and 81 of the main assembly 100 is provided with four rough guide portions 86 and 87, respectively, which guide the cartridge 7 by the left and right lengthwise ends of the bottom surface of the cartridge 7. The operator is to insert the cartridge 7 in a manner to rest the cartridge on the rough guide portions 86 and 87 so that the bottom surface of the bearing 48 of the cartridge 7 and the bottom surface 5 If of the cleaning unit frame 51, of the cartridge 7 come into contact with the rough guides 86 and 87. The guides 80 and 81 on the main assembly side are provided with four guide portions 88 and 89 for guiding a boss (which hereinafter will be referred to as boss guiding portions). The boss guiding portions 88 and 89 are on the inward surface of the left and right side walls (located at lengthwise ends of photosensitive drum 1) of the cleaning unit frame 51, respectively. As the cartridge 7 is inserted into the corresponding cartridge bay, the bosses 51*d* and 51*e*, as regulating means, (located at lengthwise ends, one for one) of the cleaning unit frame 51, engage into the grooves of the boss guiding portions 88 and 89, controlling thereby the rotational movement of the cartridge 7 in the main assembly 100. As the cartridge 7 is inserted further, the bosses 51*d* and 51*e* are forced to slide onto the boss guiding portions 88 and 89, being guided thereby.

Further, the guide 81 of the main assembly is provided with four means (84*d*, 84*e*, 84*f*, and 84*g*) for keeping the cartridges 7 pressed in the lengthwise direction (which hereinafter will be referred to simply as the cartridge pressing means 84). Thus, as each cartridge 7 is inserted into the main assembly 100, the cartridge pressing member 84 comes into contact with the guide portion 85 (FIG. 3) on the right-hand lengthwise end of the cartridge 7, pressing the cartridge 7 upon the left side wall 31. The abovementioned right-hand lengthwise end of the cartridge 7 is the right-hand wall of the cleaning unit frame 51 (cleaning unit 50).

While the cartridge 7 is inserted even deeper, it is kept pressed toward the left side wall 31 by the pressure applied to the guide portion 85 of the cartridge 7 by the cartridge pressing means. Here, the left side wall 31 of the main assembly 100 is the opposite side wall of the main assembly 100 from the right side wall 32 having the cartridge pressing means. The cleaning unit frame 51 is also provided with a cartridge positioning surface for precisely positioning the cartridge 7 relative to the main assembly 100. The cartridge positioning surface 51*c* is located at one of the lengthwise ends of the cleaning unit frame 51, and is placed in contact with the end surface of the guide 80 of the main assembly, precisely positioning the cartridge 7 in the main assembly 100 in terms of the lengthwise direction.

Next, referring to FIG. 8, the main assembly 100 is provided with a center wall 93, which is perpendicularly placed between the side walls of the main assembly 100. The center wall 93 is provided with four windows, through each of which the beam of laser light from the scanner unit 3 is projected toward the cartridge 7. Referring to FIGS. 9 and 10, the electrical contact supporting members 105 for supporting the electrical contacts 103*a* and 103*b* on the main assembly side protrude inward of the cartridge compartment through the connective hole 96*a* of the center wall 93. As the cartridge 7 is inserted into the deepest end of the cartridge bay, the electrical contacts 103*a* and 103*b* on the main assembly side come into contact with the electrical contacts 94*a* and 94*b* on the cartridge side connected to the aforementioned memory 130 for storing the information regarding the cartridge 7.

To the side walls 31 and 32 of the main assembly 100, the pair of cams 8 for placing the development unit 4 (development roller 40) in contact with the photosensitive drum 1, or separating the development unit 4 (development roller 40) from the photosensitive drum 1 are rotatably attached. The cams 8 are rotatable by the motor (unshown) provided in the main assembly 100 in order to separate the development roller 40 from the photosensitive drum 1, or to allow the development roller 40 to be placed in contact with the photosensitive drum 1. The pair of cams 8 are located at the ends of the main assembly 100, one for one, in terms of the direction parallel to the axial line of the photosensitive drum 1.

As for the positioning of each cartridge 7 in the main assembly 100 in terms of the widthwise direction of the cartridge 7, each cartridge 7 is inserted all the way into the cartridge bay, with the bearings 64 and 65, which are supporting the photosensitive drum 1, fitted in the guiding grooves 34 (34*a*, 34*b*, 34*c*, and 34*d*; 34*e*, 34*f*, 34*g*, and 34*h*) with which the side walls 31 and 32 of the main assembly 100 are provided. More specifically, referring to FIG. 9, as the cartridge 7 is inserted all the way, the bearing 64, which is located at one of the lengthwise ends of the cartridge (photosensitive drum 1), and which constitutes the first cartridge positioning portion on the cartridge side, is pressed on the cartridge positioning surfaces 37 and 38 of the guiding grove 34 (34*a*, 34*b*, 34*c*, and 34*d*), which constitutes the first cartridge positioning portion on the main assembly side, whereas the bearing 65, which is located at the other lengthwise end of the cartridge (photosensitive drum 1), and which constitutes the second cartridge positioning portion on the cartridge side, is pressed on the cartridge positioning surfaces 37 and 38 of the guiding grove 34 (34*e*, 34*f*, 34*g*, and 34*h*), which constitutes the second cartridge positioning portion on the main assembly side. As a result, the cartridge 7 is precisely positioned, in terms of the widthwise direction, relative to the main assembly 100. In other words, at the end of the insertion of the cartridge 7 into the main assembly 100, the bearings 64 and 65, and the bosses 51*d* and 51*e* located at the lengthwise ends of the cleaning unit frame 51, are precisely positioned by the boss guiding portion 88 and 89 of the guides 80 and 81, respectively, on the main assembly side.

As described above, as the cartridge 7 is inserted into the main assembly 100, the bearing 64 is precisely positioned by the cartridge positioning surfaces 37 and 38 of the guiding groove 34 of the side wall 31 of the main assembly 100, whereas the bearing 65 is precisely positioned by the cartridge positioning surfaces 37 and 38 of the guiding groove 34 of the side wall 32 of the main assembly 100.

With the provision of the above-described structural arrangement, the cleaning unit frame 51 is prevented from being rotated about the bearings 64 and 65 by the force which the cam pressure receiving portions 47*b* and 48*b* receives as the cams 8 are rotated. In other words, the bosses 51*d* and 51*e* as cartridge position regulating means prevent the cleaning unit frame 51 from rotating about the bearing 64 and 65 when the cam pressure receiving portions 47*b* and 48*b* are subjected to the force from the cams 8.

There are a roughly 0.1-0.2 mm gap (play) between the boss 51*d* and boss guiding portion 88, and a roughly tens of micrometers of gap (play) between the boss 51*e* and boss guiding portion 89.

In other words, at one end of the photosensitive drum 1 in terms of its axial direction (one end of cartridge 7 in its lengthwise direction), there is virtually no gap between the boss 51*e* (cartridge end positioning portion) and boss guiding portion 89, and therefore, one end of the cartridge 7 is secured with virtually no play. As described above, the cartridge 7 is provided with the coupling 70 and gear 71, which are located at one end of the photosensitive drum 1 in order enable the cartridge 7 to receive the rotational drive force from the main assembly 100. Further, the other end of the cartridge 7, in terms of the axial direction of the photosensitive drum 1, is provided with the boss 51*d* (cartridge positioning portion). However, the gap between the boss 51*d* (cartridge positioning portion) and boss guiding portion 88 are substantially greater than that between the boss 51*e* and boss guiding portion 89, being thereby enabled to compensate for the variation in the measurements of the above-described components, for the following reason.

That is, if the bosses 51*d* and 51*e* engage with the boss guiding portions 88 and 89 with the presence of only several tens of micrometers of play, the position of the cartridge 7 in the main assembly 100 is fixed by four contact points, that is, the contact points between the cartridge 7, and the bearings 64 and 65, and bosses 51*d* and 51*e*, making it likely for the cleaning unit frame 51 to be deformed because of the variation in the measurements of the above-described components. However, with the provision of the above-described structural arrangement, should the aforementioned four contact points deviate in position due to the variation in the measurement of the components, the cleaning unit frame 51 is not deformed.

The cartridge 7 is inserted into the main assembly 100 until the bearings 64 and 65 come into contact with the cartridge positioning surfaces 37 and 38 of the guiding groove 34. Toward the end of the insertion, the pair of bosses 105*a* and 105*b*, as positioning portions, of the electrical contact supporting member 105 on the main assembly side enter the pair of positioning holes 102*a* and 102*b* of the cartridge 7. The pair of positioning holes 102*a* and 102*b* are on the back side of the cartridge 7.

As described above, as the cartridge 7 is inserted into the main assembly 100, the boss 105*a* as the first projection enters the hole 102*a*, as the first positioning recess, of the cartridge 7, precisely positioning the electrical contacts 94*a* and 94*b* of the cartridge 7 relative to the electrical contacts 103*a* and 103*b*, respectively, on the main assembly side. Similarly, the boss 105*b*, as the second projection, enters the hole 102*b* as the second positioning recess. The positioning holes 102*a* and 102*b* belong to the cleaning unit 50.

These positioning portions, that is, the positioning holes and projections, extend roughly parallel to the direction in which the cartridge 7 is mounted, ensuring that as the cartridge 7 is inserted into the main assembly 100, the bosses 105*a* and 105*b* smoothly enter the holes 102*a* and 102*b*. In this embodiment, electrical contact between the cartridge 7 and main assembly 100 is established as the electrical contacts 94*a* and 94*b* come into contact with the electrical contacts 103*a* and 103*b* on the main assembly side. More specifically, the electrical contact 94*a* comes into contact with the electrical contact 103*a*, and the electrical contact 94*b* comes into contact with the electrical contact 103*b*.

Further, the cartridge 7 is provided with a development bias electrical contact 150 for receiving the development bias to be applied to the development roller 40, from the main assembly 100, and the main assembly 100 is provided with the development bias electrical contact (unshown) for transmitting the development bias. Thus, as the cartridge 7 is inserted into the main assembly 100, the development bias electrical contact 150 comes into contact with the development bias electrical contact on the main assembly side, establishing an electrical connection between the development roller 40 and development bias power source on the main assembly side. The electrical contact 150 is located at one end of the development unit 4 in terms of the direction parallel to the axial direction of the photosensitive drum 1, being on the end surface of the development unit 4.

Referring to FIG. 7, designated by a reference number 129 is a charge bias electrical contact, through which the cartridge 7 receives the charge bias to be applied to the charge roller, from the main assembly 100. This electrical contact 129 is located on the other end of the cartridge 7, being on the end surface of the cleaning unit 50. Designated by a reference number 140 is a development blade bias contact, through which the cartridge 7 receives the blade bias to be applied to the development blade 44, from the main assembly 100. This electrical contact 140 is located at the other end of the cartridge 7, being on the end surface of the development unit 4.

Also as the cartridge 7 is inserted into the main assembly 100, the driving gear 71 of the cartridge 7 meshes with the driving gear (unshown) on the main assembly side.

Incidentally, the cartridges 7 other than the cartridge 7 for developing yellow color, that is, the cartridges for developing magenta, cyan, and black colors, respectively, are inserted into the corresponding cartridge bays in the same manner as the cartridge 7 for developing yellow color is inserted into the bottommost cartridge bay.

Then, the hinged front door 26, which has been kept fully open, is to be closed against the main assembly 100. As the door 26 is closed, it is locked by the latching mechanism (unshown). Further, as the door 26 is closed, the following steps are carried out by means whose action is linked to the closing movement of the door 26: (1) step of pressing the cartridge 7 in the widthwise direction to precisely position the cartridge 7 in the main assembly 100; and (2) step of engaging the coupling 70 of the cartridge 7 with the coupling 108 on the main assembly side for transmitting a driving force.

Figure 9:
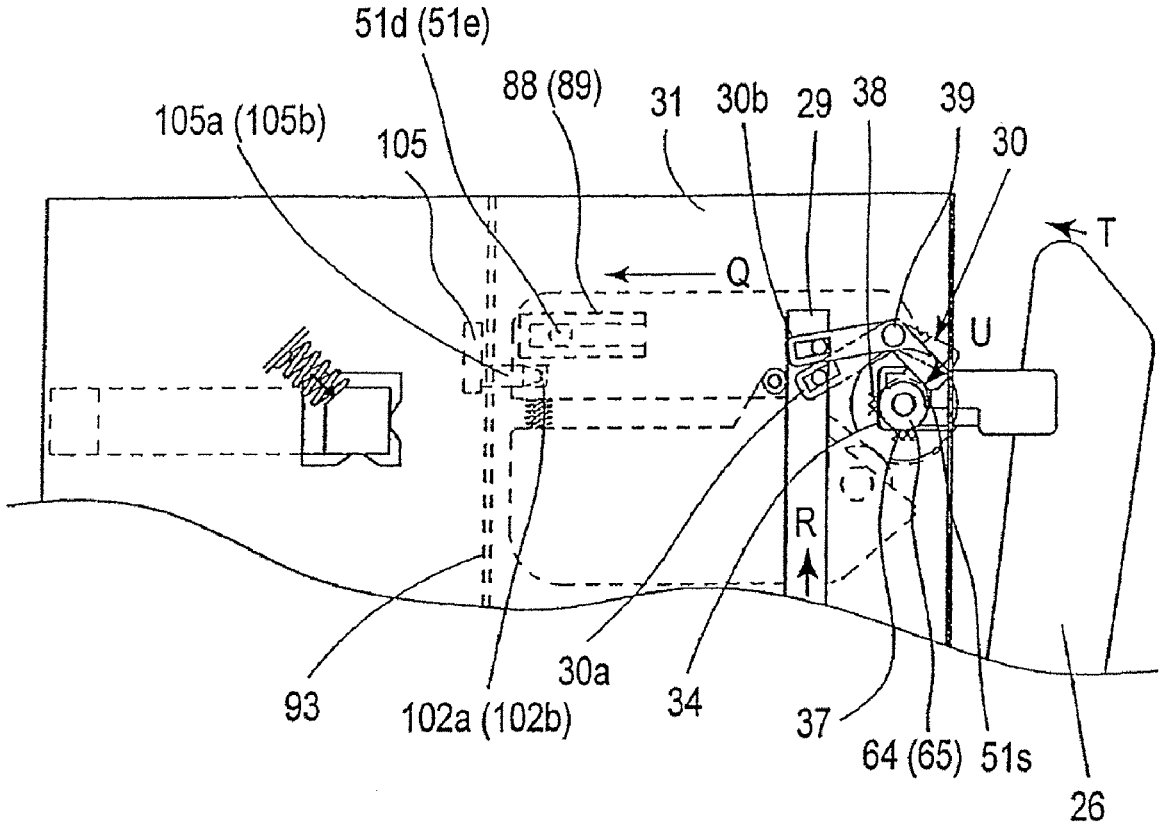
FIG. 9 is a phantom plan view of the cartridge positioning mechanism of the main assembly of the image forming apparatus, showing how the cartridge is precisely positioned relative to the main assembly in terms of the widthwise direction of the cartridge.
Figure 10:
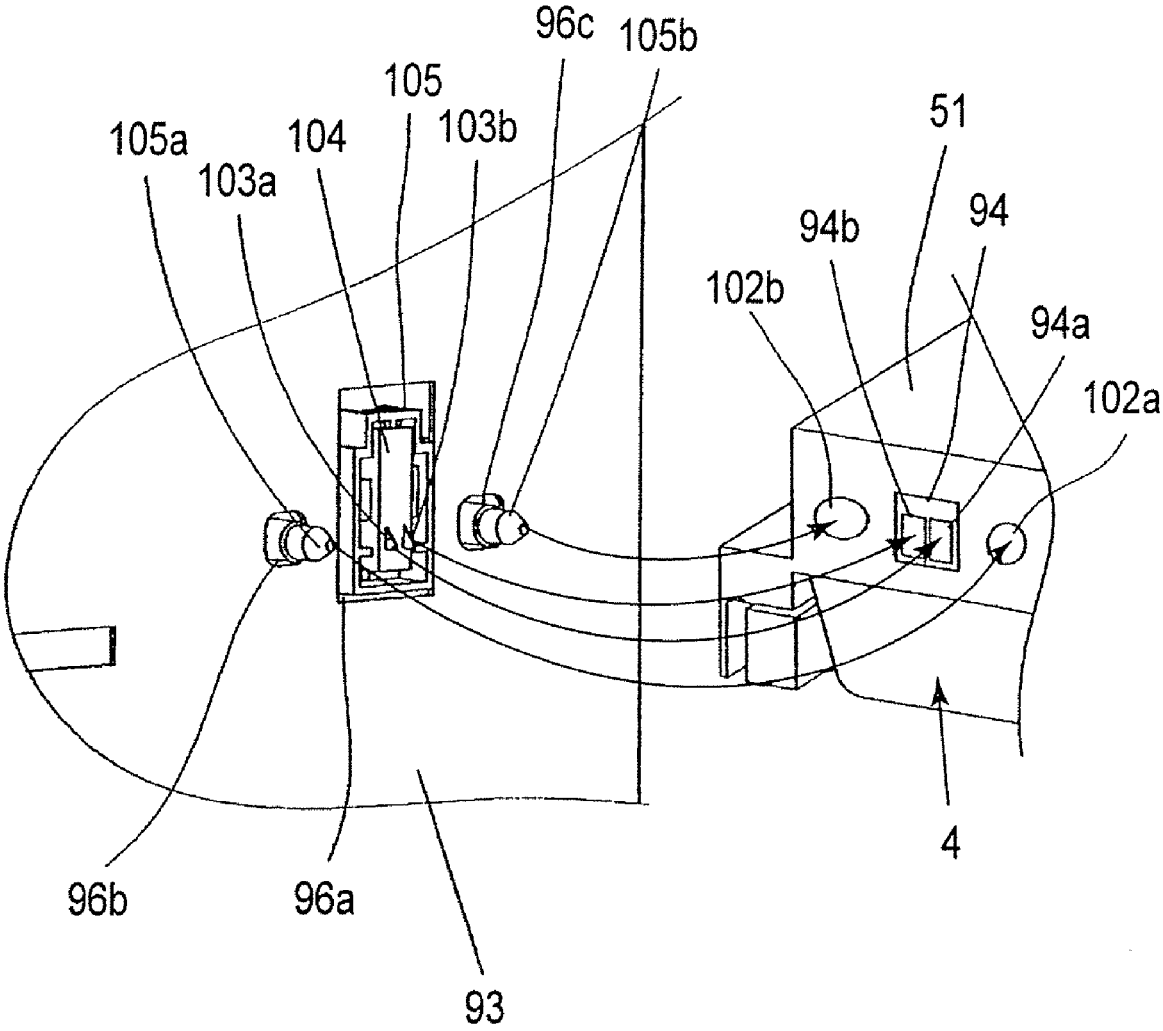
FIG. 10 is a schematic drawing for showing the electrical contacts on the cartridge side, and corresponding electrical contacts on the main assembly side of an image forming apparatus.

Step (1):

Referring to FIG. 9, the step of pressing the cartridge 7 in the widthwise direction to precisely position the cartridge 7 is carried out by the pressing member 30, the action of which is linked to the action of the mechanism for opening and closing the door 26. The pressing member 30 is rotatably supported by a shaft 39 attached to the side wall 31 of the main assembly 100 by crimping. The pressing member 30 is connected to a connective member 29, the movement of which is linked to the opening and closing movement of the door 26.

When the door 26 is fully open, that is, when the cartridges 7 are removably mountable in the main assembly 100, the pressing member 30 is in the position 30*a* outlined by the single-dot chain line in FIG. 9. This position is the position into which the pressing member 30 is retracted. While the cartridge 7 is inserted, the pressing member 30 does not come into contact with the cartridge 7.

As the door 26 is closed (in the direction indicated by arrow mark T in FIG. 9) after the mounting of the cartridge 7, the connective member 29 is moved in the direction indicated by an arrow mark R, moving thereby the pressing member 30 into the position 30*b* outlined by the solid line in FIG. 9, in which the pressing member 30 presses on the slanted surface 51*s* of the cleaning unit frame 51 in the direction indicated by an arrow mark U. As a result, the cartridge 7 is precisely positioned in the main assembly 100 in terms of the widthwise direction.

The side wall 32 of the main assembly 100 is provided with the same mechanism as the above-described one with which the side wall 31 is provided. Thus, it is ensured that as the door 26 is closed, the cartridge 7 is precisely positioned in the main assembly 100 in terms of the widthwise direction.

Step (2):

As the door 26 is closed, each of the couplings 108 on the main assembly side is moved by the closing movement of the door 26 in the direction to engage with the coupling 70 of the cartridge 7. Thus, while the cartridge 7 is in the proper position in the main assembly 100, the coupling 108 on the main assembly side remains engaged with the coupling 70 of the cartridge 7, making it possible for a driving force to be transmitted to the coupling 70 from the motor (unshown) provided on the main assembly side. As the driving force is transmitted, the photosensitive drum 1 of the cartridge 7 is rotationally driven in the counterclockwise direction in FIG. 1. Further, the developer moving mechanism 52 in the removed developer chamber 53 is driven by the rotation of the photosensitive drum 1, through the gear train (unshown).

Also, while the cartridge 7 is in the proper position in the main assembly, the driving gear 71 of the cartridge 7 remains meshed with the driving gear (unshown) on the main assembly side, allowing thereby the gear 71 to receive a driving force from the gear on the main assembly side. As the driving force is received by the gear 71, the development roller 40, the developer conveying mechanism 42, and the developer supply roller 43 of the cartridge 7 are rotated by the rotation of the gear 71 through the gear train (unshown).

The procedure for removing each of the cartridges 7 from the main assembly 100 is the reverse of the above-described procedure for mounting each cartridge 7 into the main assembly 100. In other words, first, the door 26 is to be unlocked by releasing the latching mechanism, and then, opened frontward so that the door 26 is rotated about the hinge shaft 27 located at the bottom of the door 26. As the door 26 is opened, each cartridge 7 is freed by means, the action of which is linked to the movement of the door 26, from the pressure which has been applied thereon by the pressing member 30. At the same time, the coupling 108 on the main assembly side is disengaged from the coupling 70 of the cartridge 7. Then, an operator is to grasp the handles 82 and 83 with the left and right hands, one for one, and to pull the cartridge 7 in the direction opposite to the direction in which the cartridge is pushed during the mounting of the cartridge 7. This will remove the cartridge 7 from the main assembly 100.

{Structural Arrangement for Keeping Electrical Contacts of Cartridge Connected to Electrical Contacts of Main Assembly}

Next, the structural arrangement for connecting the electrical contacts 94*a* and 94*b* of the memory 130 of the cartridge 7 to the electrical contacts 103*a* and 103*b* of the main assembly 100 will be described.

As described above, the cartridge 7 is provided with the memory board 94, which is attached to the back side of the cleaning unit frame 51. Referring to FIG. 10, the main assembly 100 is provided with the electrical contact supporting portion 104 for supporting the electrical contacts 103*a* and 103*b* of the main assembly, and the electrical contact supporting member 105 for supporting the electrical contact supporting portion 104. The supporting portion 104 and supporting member 105 project into the cartridge compartment through the connective hole 96*a* of the aforementioned center wall 93 of the main assembly frame. The electrical contacts of the main assembly 100 are placed in contact with the electrical contacts 94*a* and 94*b* of the memory board 94 to establish an electrical connection between the memory 130 and the control portion of the main assembly 100.

When mounting the cartridge 7 into the cartridge compartment of the main assembly 100, the cartridge 7 is to be inserted from the back side of the cartridge 7, and is to be inserted deep enough for the bearings 64 and 65 come into contact with the cartridge positioning surfaces 37 and 38 of the corresponding guiding grooves 34. During this insertion of the cartridge 7, the bosses 105*a* and 105*b* of the supporting member 105 of the main assembly 100 enter the positioning holes 102*a* and 102*b* of the cartridge 7. As a result, the electrical contacts 94*a* and 94*b* of the memory board 94 come into contact with the electrical contacts 103*a* and 103*b* of the main assembly 100, establishing an electrical connection between the memory 130 of the cartridge 7 and the control portion of the main assembly 100.

In terms of the direction in which the cartridge 7 is inserted into the main assembly 100, the memory board 94 (memory 130) and the positioning holes 102*a* and 102*b* are located at the leading end of the cleaning unit 50, whereas in terms of the lengthwise direction of the cleaning unit 50, that is, the lengthwise direction of the photosensitive drum 1, they are located at the end where the gear 71, which will be described later, is located.

As the electrical contacts 94*a* and 94*b* of the memory board 94 come into contact with the electrical contacts 103*a* and 103*b* of the main assembly 100, it becomes possible for electrical information to be exchanged between the memory 130 and the control circuit (unshown) of the apparatus main assembly 100. In order to insure the reliability of the electrical connection between the electrical contacts 94*a* and 94*b* of the cartridge 7 and the electrical contacts of the main assembly 100, the surfaces of the electrical contacts are plated with gold. More specifically, the electrical contacts 103*a* and 103*b* of the main assembly 100 and electrical contacts 94*a* and 94*b* of the cartridge 7 are formed of gold-plated copper plate.

As the cartridge 7 is inserted into the main assembly 100, the boss 105*a* as the first projection of the supporting member 105 fits into the positioning hole 102*a* as the first recess of the cleaning unit frame 51, and the boss 105*b* as the second projection of the supporting member 105 fits into the positioning hole 102*b* as the second recess of the cleaning unit frame 51. The supporting member 105 is integral with the electrical contact supporting portion 104 to which the electrical contacts 103*a* and 103*b* of the main assembly 100 are attached.

Incidentally, it is unnecessary for the bosses 105*a* and 105*b* to be firmly fitted in the positioning holes 102*a* and 102*b;* in other words, all that is necessary is that as the former fit into the latter, so that the electrical contacts on the two sides are properly positioned relatively to each other.

The electrical contact supporting portion 104 is long enough to protrude into the cartridge compartment through the connective hole 96*a* of the center wall 93 of the main assembly frame. Further, the bosses 105*a* and 105*b* of the electrical contact supporting member 105 are long enough to protrude into the cartridge compartment through the holes 96*b* and 96*c* of the center wall 93 of the main assembly frame. The supporting member 105 is mounted so that it is allowed to move vertically as well as horizontally, that is, in the direction perpendicular to the direction in which the cartridge 7 is mounted into the main assembly 100.

More specifically, the cross sections of the connective hole 96*a,* and the holes 96*b* and 96*c,* are larger than the cross sections of the supporting member 105 and the bosses 105*a* and 105*b,* respectively, allowing the supporting member 105 to move in the above-described direction by the distance equal to the difference between the cross sections of the holes 96*a,* 96*b,* and 96*c,* and the cross sections of the supporting member 105, and bosses 105*a* and 105*b,* respectively. The sizes of the cross sections of the holes 96*a,* 96*b,* and 96*c* and the sizes of the cross sections of the supporting member 105, and bosses 105*a* and 105*b*, are set so that the distance by which the supporting member 105 is allowed to move in the above-described direction will be greater than the distance by which the cartridge 7 is allowed to deviate in position within the main assembly 100 because of the presence of gaps between the cartridge 7 and the corresponding cartridge bay in the main assembly 100 during and/or after the mounting of the cartridge 7 into the main assembly 100. Therefore, even if the cartridge 7 deviates in position in the main assembly 100, the supporting member 105 is allowed to move with the cleaning unit frame 51, with which it is connected while the cartridge 7 is in the main assembly 100. Therefore, the electrical contacts 94*a* and 94*b* of the cartridge 7 and the electrical contacts of the main assembly are prevented from rubbing against each other.

In this embodiment, the electrical contacts 94*a* and 94*b* of the cartridge 7 are located at one end of the cleaning unit frame 51, and between the positioning holes 102*a* and 102*b*, in terms of the lengthwise direction. Further, in terms of the lengthwise direction, the positioning hole 102*a* is on the same side as the electrical contact 94*a*, and the positioning hole 102*b* is on the same side as the electrical contact 94*b*. In other words, the positioning holes 102*a* and 102*b* are positioned in a manner to sandwich the electrical contacts 94*a* and 94*b*. Therefore, fitting of the positioning bosses 105*a* and 105*b* into the positioning holes 102*a* and 102*b* ensures that the electrical contacts on two sides are placed, and remain, in contact with each other, and move together without rubbing against each other.

As described above, as the cartridge 7 is inserted into the main assembly 100, the positioning boss 105*a* fits into the positioning hole 102*a*, and similarly, the positioning boss 105*b* fits into the positioning hole 102*b*. With the provision of this structural arrangement, as the cleaning unit frame 51 is rotated about the bearings 64 and 65 by the force it receives through the pressure receiving portions 47*b* and 48*b* thereof from the cams 8 as the pressure applying members, in order to separate the development roller 40 from the photosensitive drum 1, the electrical contacts 94*a* and 94*b* of the cartridge 7 move with the electrical contacts 103*a* and 103*b* of the main assembly 100. Therefore, even if the cleaning unit frame 51 is rotated, the electrical contact 94*a* and electrical contact 103*a* do not rub against each other, nor do the electrical contact 94*b* and electrical contact 103*b*. In other words, this embodiment improves the image forming apparatus in terms of the level of reliability of the electrical connection between the cartridge 7 and main assembly 100.

In this embodiment, the positioning holes 102*a* and 102*b* are located at one of the lengthwise ends of the cleaning unit fame 51, and are horizontally aligned with the electrical contacts 94*a* and 94*b* in a manner to sandwich the electrical contacts 94*a* and 94*b*. However, the positioning holes 102*a* and 102*b* may be aligned in the direction perpendicular to the direction in which they are aligned in this embodiment; for example, they may be vertically aligned in a manner to sandwich the electrical contacts 94*a* and 94*b*. Such an arrangement can provide the same effects as those provided by this embodiment.

Figure 11:
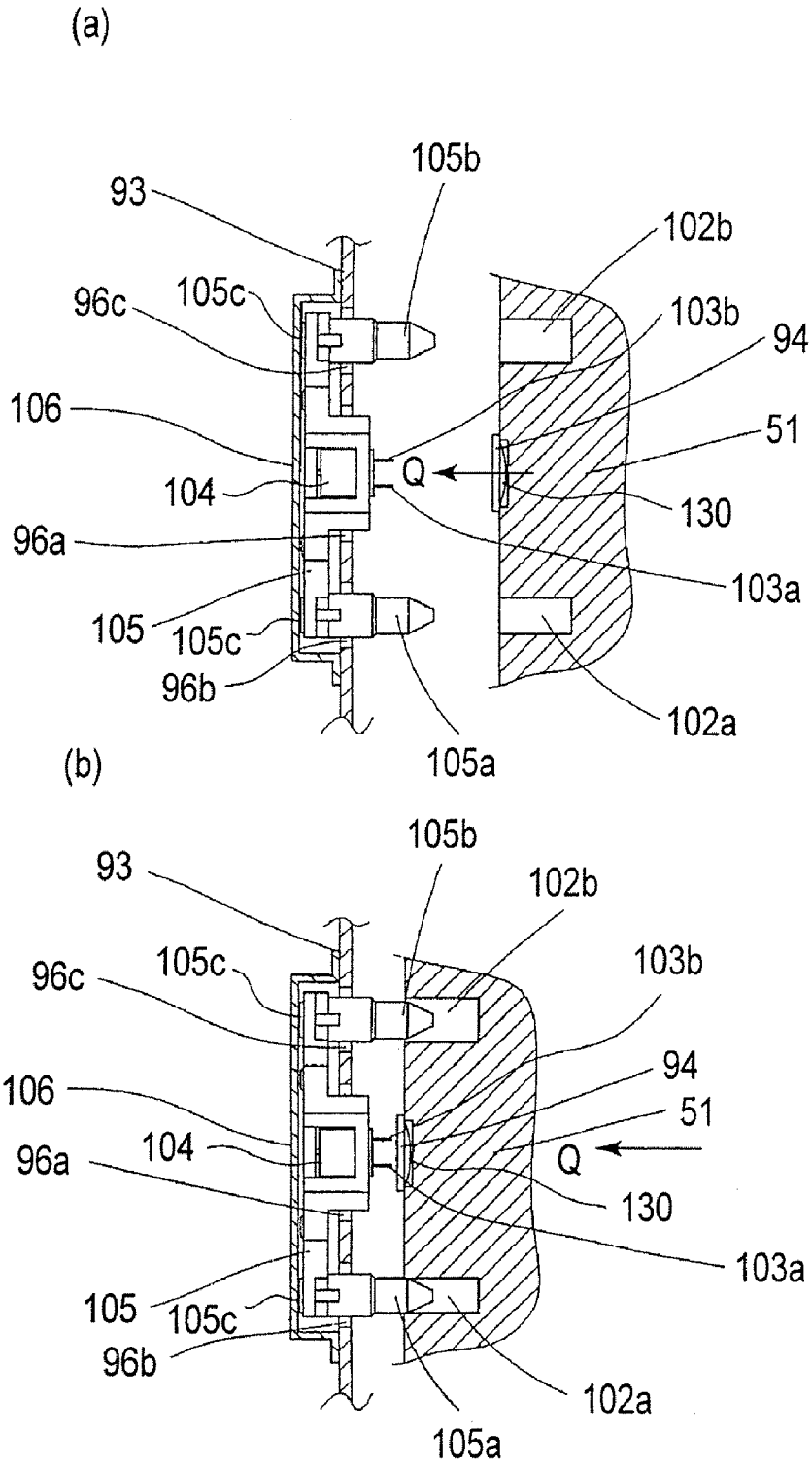
FIGS. 11(*a*) and 11(*b*) are sectional views of the electrical connective portion of the cartridge and the electrical connective portion of the main assembly of an image forming apparatus, with FIGS. 11(*a*) and 11(*b*) showing their states before and while they are engaged, respectively.

Referring to FIG. 11, the main assembly 100 is provided with a movement regulating portion 106 for regulating the movement of the electrical contact supporting member 105. The regulating portion 106 is located on the back side (scanner unit side of center wall 93) of the supporting member 105, as seen from the direction (Q) in which the cartridge 7 is inserted into the main assembly 100. The movement regulating member 106 is attached to the center wall 93. In other words, the main assembly 100 of the image forming apparatus is provided with the movement regulating member 106, which is located on the downstream side from the supporting member 105 in terms of the direction the cartridge 7 in which the cartridge 7 advances into the main assembly 100. Thus, as the supporting member 105 is pushed inward of the main assembly 100 by the advancing cartridge 7 when the cartridge 7 is inserted into the main assembly 100, the supporting member 105 comes into contact with the supporting member movement regulating member 106, being thereby prevented from being moved further inward. Therefore, as the supporting member 105 is pushed inward of the main assembly 100, that is, downstream in terms of the cartridge mounting direction, the back surface 105*c* of the supporting member 105 comes into contact with the supporting member movement regulating member 106, preventing thereby the supporting member 105 from being moved further downstream. Therefore, it is ensured that the electrical contacts 103*a* and 103*b* and the electrical contacts 94*a* and 94*b* of the memory board 94 of the cartridge 7 are placed in contact with each other, and also, that a proper amount of contact pressure is maintained between the supporting member 105 and the cartridge 7. Therefore, it does not occur that the electrical contacts 105*a* and 105*b* of the main assembly 100 fail to be properly placed, and remain, in contact with the electrical contacts 94*a* and 94*b* of the cartridge 7.

Also, as the cartridge 7 is inserted into the main assembly 100, first, the supporting member 105 engages with the cleaning unit frame 51; more specifically, the tips of the positioning bosses 105*a* and 105*b* enter the positioning holes 102*a* and 102*b* of the cleaning unit frame 51, as shown in FIG. 11(*b*). Then, as the cartridge 7 is inserted further, virtually the entireties of the positioning bosses 105*a* and 105*b* enter the positioning holes 102*a* and 102*b*, respectively. Then, as the cartridge 7 is inserted even deeper, the electrical contacts 94*a* and 94*b* of the cartridge 7 come into contact with the electrical contacts 103*a* and 103*b* of the main assembly 100.

The positioning bosses 105*a* and 105*b* of the main assembly 100 are pointed at the top so that even if the positioning bosses 105*a* and 105*b* of the supporting member 105 become slightly deviated in position, relative to the positioning holes 102*a* and 102*b* of the cartridge 7, in the lengthwise direction and/or the direction perpendicular to the lengthwise direction, while the cartridge 7 is mounted into the main assembly 100, the positioning bosses 105*a* and 105*b* are guided into the positioning holes 102*a* and 102*b*. With the provision of the above-described structural arrangement, it is assured that as the cartridge 7 is inserted into the main assembly 100, the positioning bosses 105*a* and 105*b* are positioned so that their axial lines align with the axial lines of the positioning holes 102*a* and 102*b*.

Incidentally, even if the positioning bosses 105*a* and 105*b* are provided on the cleaning unit frame side, and the positioning holes 102*a* and 102*b* are provided on the supporting member side, the supporting member 105 is allowed to move with the cleaning unit frame 51. However, if such an arrangement is employed, the cartridge 7 will have protruding portions, which will possibly be damaged while the cartridge 7 is handled. In comparison, in this embodiment, the cleaning unit frame 51 is provided with the positioning holes 102*a* and 102*b*, making it easier to handle the cartridge 7.

Figure 12:
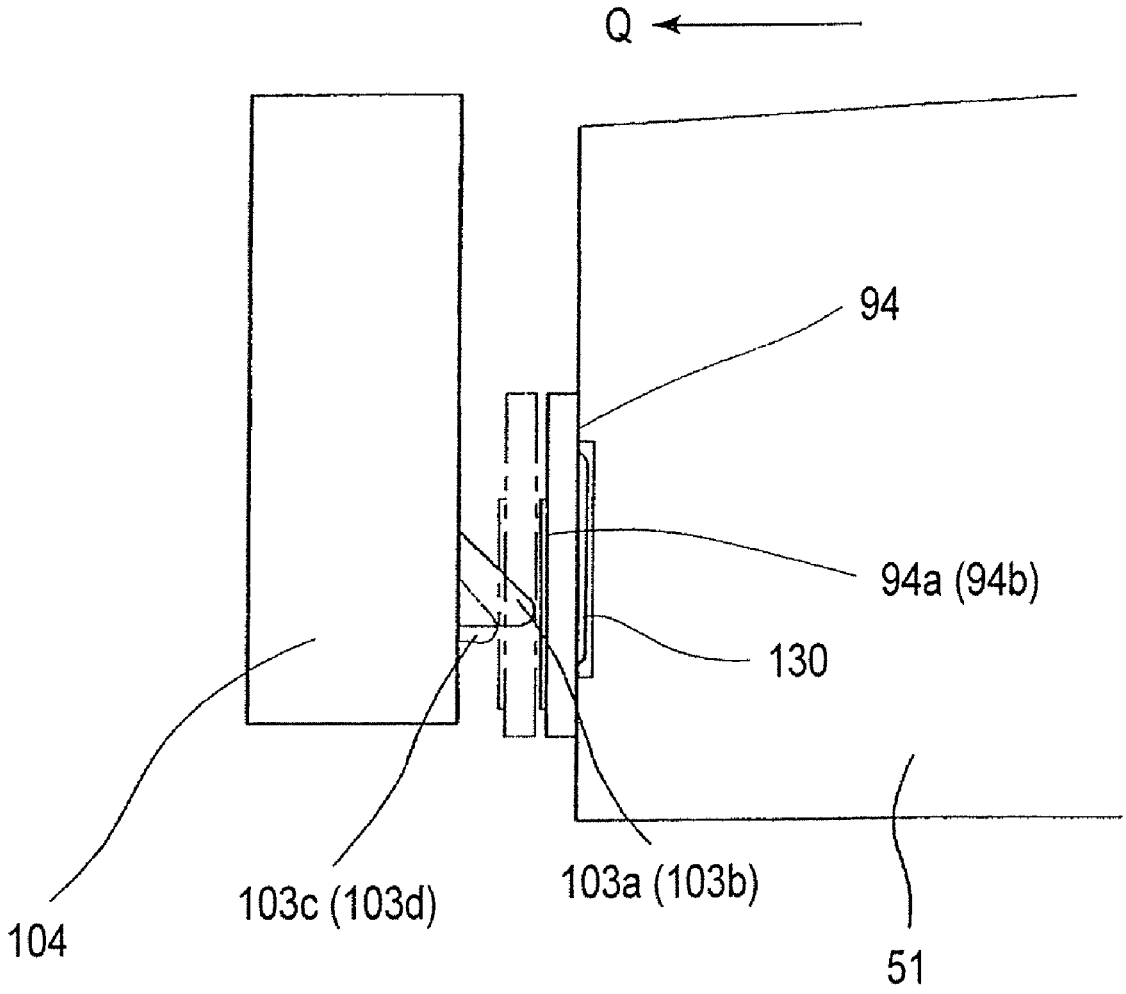
FIG. 12 is a schematic drawing showing the state of contact between the electrical contacts on the cartridge side and the electrical contacts on the main assembly side.
Figure 13:
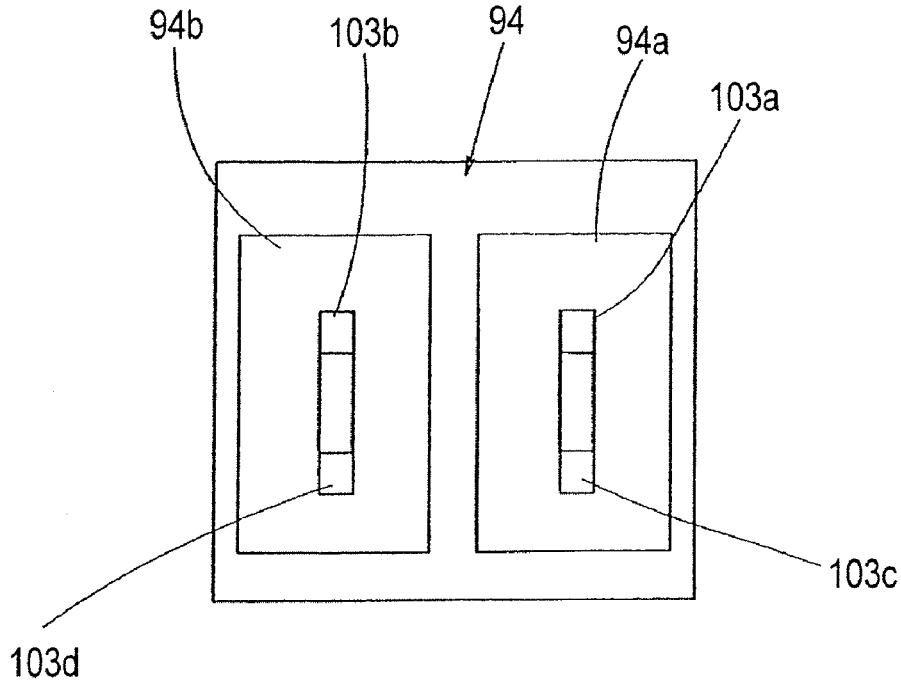
FIG. 13 is a schematic drawing showing the wiping of the electrical contact points.
Figure 14:
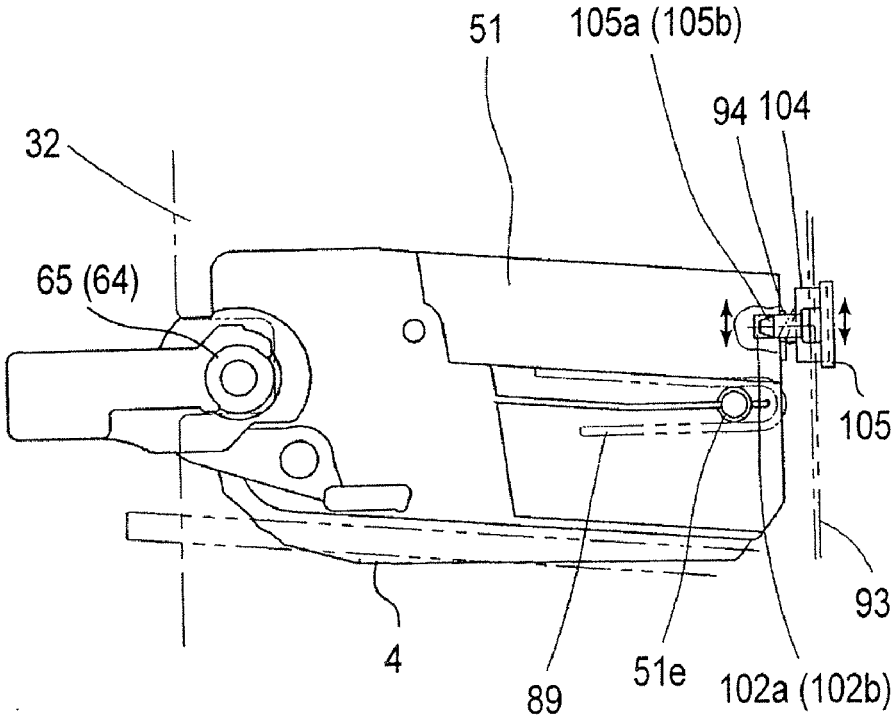
FIG. 14 is a side view of the cartridge and its adjacencies, showing how the supporting member of the main assembly moves with the cleaning unit frame as the cleaning unit frame moves.

Referring to FIGS. 12 and 13, the memory board 94 is attached to the back surface of the cleaning unit frame 51, being positioned perpendicular to the cartridge insertion direction (indicated by arrow mark Q). In other words, the memory board 94 is positioned perpendicular to the direction in which the positioning bosses 105*a* and 105*b* are fitted into the positioning holes 102 and 102*b*. Thus, as the cartridge 7 is inserted into the main assembly 100, the memory board 94 remains parallel to the electrical contact supporting portion 104, and the electrical contacts 94*a* and 94*b* come into contact with the electrical contacts 103*a* and 103*b* of the main assembly 100.

The electrical contacts 103*a* and 103*b* are fitted with a spring (unshown) so that they are kept projecting from the electrical contact supporting portion 104 by the pressure generated by the spring. Thus, as they are pushed by a force greater than a predetermined amount of force, they partially retract into the electrical contact supporting portion, as indicated by the double-dot chain line in FIG. 12. In other words, the electrical contacts 103*a* and 103*b* of the main assembly 100 are enabled to advance or retract in the direction parallel to the cartridge insertion direction. Therefore, as the cartridge 7 is inserted into the main assembly 100, the electrical contacts 103*a* and 103*b* of the main assembly 100 are pushed back into the position 103*c* (103*d*) outlined by the double-dot chain line, by the electrical contacts 94*a* and 94*b* of the cartridge 7 while remaining in contact with the electrical contacts 94*a* and 94*b,* and also, remaining in parallel to the memory board 94 (portion of memory board 94 outlined by double-dot chain line). In other words, the electrical contacts 103*a* and 103*b* of the main assembly 100 move to the positions 103*c* and 103*d* while sliding on the electrical contacts 94*a* and 94*b,* as shown in FIG. 13.

As described above, as the cartridge 7 is inserted into the main assembly 100, the electrical contacts 103*a* and 103*b* of the main assembly 100 come into contact with the electrical contacts 94*a* and 94*b* of the cartridge 7, and then, are moved by the further insertion of the cartridge 7. As a result, the electrical contacts 103*a* and 103*b* and the electrical contacts 94*a* and 94*b* wipe each other. Therefore, even if foreign matter has adhered to the electrical contacts, it will be wiped away, ensuring that the electrical contacts on two sides come into contact, and remain in contact, with each other. It should be noted here that in this embodiment, the distances of the wiping movement of the electrical contacts 103*a* and 103*b* relative to the electrical contacts 94*a* and 94*b,* respectively, are set by keeping the memory board 94 in parallel to the supporting member 105 while the memory board 94 (cartridge 7, cleaning unit frame 51) is moved toward the supporting member 105.

Since the electrical contacts 94*a* and 94*b* of the cartridge 7 are positioned so that their contact surfaces become perpendicular to the cartridge insertion direction, they are maximized in terms of the contact area between them and the electrical contacts 103*a* and 103*b* of the main assembly 100. Further, the electrical contacts 94*a* and 94*b* of the cartridge 7 and the electrical contacts 103*a* and 103*b* are made to come into contact with each other so that their contact surfaces remain parallel to each other, ensuring that they come into contact, and remain in contact, with each other.

Incidentally, the aforementioned term wiping means that the electrical contacts 94a and 94*b* of the cartridge 7 and the electrical contacts 103*a* and 103*b* rub against each other. However, the number of times they wipe each other is equal to the number of times the cartridge 7 is replaced with another cartridge (7). In addition, the number of times the cartridge 7 is replaced with another cartridge (7) is extremely small compared to the number of copies outputted throughout the service life of an image forming apparatus. Therefore, the amount by which the electrical contacts 103*a* and 103*b* of the main assembly 100 are shaved due to the normal exchange of the cartridge 7 is negligible; the electrical contacts 103*a* and 103*b* are simply wiped clean.

As the cartridge 7 is mounted into the main assembly 100, the supporting member 105 is supported by the cleaning unit frame 51 in a manner to be an integral part of the cleaning unit frame 51. Thus, even if the cartridge 7 moves in the main assembly 100, the supporting member 105 moves with the cleaning unit frame 51, preventing thereby the electrical contacts 103*a* and 103*b* of the main assembly 100 and electrical contacts 94*a* and 94*b* of the cartridge 7 from rubbing against each other.

As the cams 8 are rotated to place the development roller 40 in contact with the photosensitive drum 1, or to separate the development roller 40 from the photosensitive drum 1, while the cartridge 7 is in the main assembly 100, the development unit 4 pushes the cleaning unit frame 51 upward through the compression spring 54 (FIG. 7), or reduces the pressure it is applying to the cleaning unit frame 51 through the compression spring 54, respectively.

As described above, there are slight gaps between the bosses 51*d* and 51*e* of the cleaning unit frame 51 and the boss guides 88 and 89 of the main assembly 100, allowing the cleaning unit frame 51 to move by the distances equal to the sizes of these gaps. Further, as the development unit 4 is moved to place the development roller 40 in contact with the photosensitive drum 1, or to separate the development roller 40 from the photosensitive drum 1, the cleaning unit frame 51 and/or the guides 80 and 81 on the main assembly side may sometimes be deformed, and if they are deformed, the memory board 94 and/or electrical contact supporting portion 104 are moved.

If the cartridge 7 and the main assembly 100 are not structured as they are in this embodiment, that is, if the electrical contact supporting portion 104 is solidly fixed to the main assembly 100, being therefore not allowed to move with the cleaning unit frame 51, the electrical contacts 94*a* and 94*b* of the cartridge 7 and the electrical contacts 103*a* and 103*b* slide on each other by a minute distance. Thus, it is possible that the electrical contacts 103*a* and 103*b* of the main assembly 100 of an image forming apparatus with a long service life will be shaved by a substantial amount, since the above-described sliding action of the electrical contacts 94*a* and 94*b* of the cartridge 7 and the electrical contacts 103*a* and 103*b* of the main assembly 100 upon each other is repeated by the number of times equivalent to the length of the service life of the image forming apparatus.

If the electrical contacts 103*a* and 103*b* of the main assembly 100 are shaved, it is possible that contact failure will occur at the shaved portions of the electrical contacts 103*a* and 103*b;* in other words, it is possible that a communication failure will occur between the memory 130 and the control portion of the main assembly 100, for the following reason. That is, generally, the voltage between the memory 130 and the main assembly 100 is lower than those applied to the charge roller and development roller. Therefore, once the base metal (copper, for example) becomes exposed, and oxidized, because the gold surface layers of the electrical contacts 103*a* and 103*b* of the main assembly 100 are shaved away as they are rubbed by the electrical contacts 94*a* and 94*b* of the cartridge 7, the electrical connection between the electrical contacts 103*a* and 103*b* and electrical contacts 94*a* and 94*b* is interrupted.

However, in this embodiment, the electrical contact supporting portion 104 moves with the cleaning unit frame 51 as described above. Therefore, it does not occur that the electrical contacts 103*a* and 103*b* and the electrical contacts 94*a* and 94*b* fail to be properly connected in terms of their electrical connection.

Incidentally, in the case of the electrical contact structure in accordance with the prior art, the shaving of the electrical contacts 103*a* and 103*b* of the main assembly 100 did not become problematic until the cumulative number of copies outputted by the apparatus reached roughly 150,000 which is calculated based on A4 size paper. However, in recent years, demand for an image forming apparatus, the length of the service life of which is equivalent to 400,000 copies, has been increasing. In the case of an image forming apparatus, whose service life is equivalent to 400,000 copies or the like, it is necessary for the electrical contacts 103*a* and 103*b* not to be substantially shaved throughout the long service life of an image forming apparatus.

Regarding this concern, in this embodiment, the positioning bosses 105*a* and 105*b* of the supporting member 105 fit into the positioning holes 102*a* and 102*b* of the cleaning unit frame 51, and move with the cleaning unit frame 51. Therefore, even if the cleaning unit frame 51 moves slightly, the electrical contacts 94*a* and 94*b* of the cartridge 7 and the electrical contacts 103*a* and 103*b* of the main assembly 100 do not rub against each other, and therefore, it does not occur that the electrical contacts 103*a* and 103*b* are shaved by a substantial amount.

In other words, this embodiment of the present invention offers the following effects.

Even if the cartridge 7 is slightly vibrated by the process for placing the development roller 40 in contact with the photosensitive drum 1, or by separating the development roller 40 from the photosensitive drum 1, the electrical contacts 103*a* and 103*b* of the main assembly 100 are prevented from being worn by the friction, and therefore, communication failure does not occur between the memory 130 and the control portion of the main assembly. In other words, this embodiment can improve an image forming apparatus in terms of the level of reliability of the electrical connection between a process cartridge and the main assembly of an image forming apparatus.

As the cartridge 7 is inserted into the main assembly 100, the electrical contacts 103*a* and 103*b* are reliably guided to the electrical contacts 94*a* and 94*b* of the cartridge 7, being thereby prevented from coming in contact with the portions of the electrical contacts electrical contacts 94*a* and 94*b* other than their designated contact points. Therefore, the electrical contacts 103*a* and 103*b* are not rubbed by the electrical contacts 94*a* and 94*b*. Therefore, this embodiment can prevent the failure in electrical connection between the electrical contacts 103*a* and 103*b* and the electrical contacts 94*a* and 94*b* attributable to the sliding of the electrical contacts 94*a* and 94*b* on the electrical contacts 103*a* and 103*b*.

Further, referring to FIGS. 12 and 13, the insertion of the cartridge 7 into the main assembly 100 causes the electrical contacts 103*a* and 103*b* of the main assembly 100 and the electrical contacts 94*a* and 94*b* of the cartridge 7 to wipe each other. Therefore, even if foreign matter, which interferes with the electrical connection, adheres to the contact points of the electrical contacts 103*a*, 103*b*, 94*a*, and 94*b*, the electrical contacts 103*a* and 103*b* and the electrical contacts 94*a* and 94*b* remove the foreign matter as they come into contact with each other, ensuring that a satisfactory electrical connection is established between the electrical contacts 103*a* and 103*b* and the electrical contacts 94*a* and 94*b*, respectively.

Further, the wiping actions of the electrical contacts, which remove the foreign matter from the electrical contacts, are automatically caused by the insertion of the cartridge 7 into the main assembly 100. Therefore, it is unnecessary for a user to perform an operation dedicated to the removal of the foreign matter.

Further, in this embodiment, the bosses 51*e* and the boss guide 89 as the rotation regulating portions, which are located on the same lengthwise end of the cartridge 7 as the lengthwise end where the coupling 70 for transmitting a driving force to the photosensitive drum 1, and the gear 71 for transmitting the driving force to the development roller 40, are located in terms of the lengthwise direction of the cartridge 7, are fitted with each other with no play. Also, in terms of the lengthwise direction of the cartridge 7, the electrical contacts 94*a* and 94*b* of the cartridge 7 are attached to the same end as the boss 51*e*. Therefore, the electrical contacts 94*a* and 94*b* are unlikely to be forced to move when the cams 8 are rotated to rotate the development unit 4 in order to place the development roller 40 in contact with the photosensitive drum 1, or separate it therefrom.

Further, referring to FIG. 4, in this embodiment, in terms of the lengthwise direction of the cartridge 7, the gear 71, and the electrical contacts 94*a* and 94*b* of the cartridge 7, are positioned inward of the coupling 70, the bearing 65, and the boss 51*e*. Therefore, the electrical contacts 94*a* and 94*b* are even more unlikely to be forced to move when the cams 8 are rotated to rotate the development unit 4 in order to place the development roller 40 in contact with the photosensitive drum 1, or to separate it therefrom.

As described above, in terms of the direction parallel to the axial line of the photosensitive drum 1 (lengthwise direction of frame 51), the gear 71, as a portion through which the development roller 40 receives the driving force, and the electrical contacts 94*a* and 94*b* of the cartridge 7, are positioned on the inward side from the coupling 70 as the portion through which the photosensitive drum 1 receives the driving force, and the boss 51*e* (as the cartridge position regulating portion), as seen from the downstream of the direction in which the cartridge 7 is inserted into the main assembly 100.

Miscellaneous Embodiments

In the above-described embodiment, the electrical contact supporting portion 104 having the electrical contacts 103*a* and 103*b* of the main assembly 100 is supported by the supporting member 105. However, the electrical contact supporting portion 104 may be formed as an integral part of the supporting member 105.

Also in the above-described embodiment, the image forming apparatus was an electrophotographic color image forming apparatus of the contact development type, and the cartridges therefor. However, the present invention is also applicable to an electrophotographic monochromatic image forming apparatus, an image forming apparatus of the non-contact type, as well as a development unit and a developer container unit, which are mountable in the main assembly of an electrophotographic image forming apparatus.

Also in the above-described embodiment, the process cartridge comprised a photosensitive drum and a minimum of one processing means. As examples of a processing means, there are a charging means, a developing means, and a cleaning means. Therefore, a process cartridge may be a cartridge in which a charging means, a developing means or a cleaning means, and a photosensitive drum, are integrally disposed, and which is removably mountable in the main assembly of an electrophotographic image forming apparatus, a cartridge in which a minimum of one processing means among a charging means, a developing means, a cleaning means, and a photosensitive drum, are integrally disposed, and which is removably mountable in the main assembly of an electrophotographic image forming apparatus, or a cartridge in which a minimum of a developing means, and a photosensitive drum, are integrally disposed, and which is removably mountable in the main assembly of an electrophotographic image forming apparatus.

Further, an electrophotographic image forming apparatus is an apparatus for forming images on recording medium with the use of an electrophotographic image forming method. It includes, for example, an electrophotographic copying machine, an electrophotographic printer (for example, a laser beam printer, an LED printer, etc.), a facsimile machine, a word processor, etc.

In the above-described embodiment, as the process cartridge 7 is mounted into the main assembly 100 of the electrophotographic image forming apparatus, the positioning boss 105*a* as the first projection fits into the positioning hole 102*a* as the first recess, and the positioning boss 105*b* as the second projection fits into the positioning hole 102*b* as the second recess. Therefore, the electrical contacts 94*a* and 94*b* of the cartridge 7 are made to move with the electrical contacts 103*a* and 103*b* of the main assembly 100. Therefore, even if the cleaning unit frame 51 is rotated, the electrical contacts 103*a* and 103*b* of the main assembly 100 do not rub against the electrical contacts 94*a* and 94*b* of the cartridge 7, respectively. Therefore, the combination of the cartridge 7 and the main assembly 100 in this embodiment is superior to a combination of a process cartridge and a main assembly of an image forming apparatus in accordance with the prior art, in terms of the reliability of the electrical connection between a process cartridge and main assembly.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 223778/2004 and 330449/2004 filed Jul. 30, 2004 and Nov. 15, 2004, respectively, which are hereby incorporated by reference.

What is claimed is:

1. A process cartridge detachably mountable to a main assembly of an electrophotographic image forming apparatus, the main assembly including a main assembly electrical contact, a first projection, a second projection, a force application member, a first main assembly positioning portion, a second main assembly positioning portion and a movable supporting member supporting the main assembly electrical contact, the first projection and the second projection, said process cartridge comprising:

a first frame;

a second frame rotatably connected with said first frame;

an electrophotographic photosensitive drum provided in said first frame;

a first portion to be positioned, being positioned to the first main assembly positioning portion when said process cartridge is set in the main assembly of the apparatus, said first portion to be positioned projecting outwardly from said first frame substantially coaxially with an axis of said electrophotographic photosensitive drum at one end of said first frame with respect to the direction of the axis of said electrophotographic photosensitive drum;

a second portion to be positioned, being positioned to the second main assembly positioning portion when said process cartridge is set in the main assembly of the apparatus, said second portion to be positioned projecting outwardly from said first frame substantially coaxially with the axis of said electrophotographic photosensitive drum at the other end of said first frame with respect to the direction of the axis of said electrophotographic photosensitive drum;

a developing roller, contactable to said electrophotographic photosensitive drum provided in said second frame, and configured and positioned to develop an electrostatic latent image formed on said electrophotographic photosensitive drum;

an elastic member that applies an elastic force to said first frame and said second frame to contact said electrophotographic photosensitive drum and said developing roller to each other;

a force receiving portion, provided in said second frame, and configured and positioned to receive a force from the force application member to space said electrophotographic photosensitive drum and said developing roller from each other;

a first regulating portion configured and positioned to engage with the main assembly to regulate the rotation of said first frame about said first portion to be positioned and said second portion to be positioned when said force receiving portion receives the force from the force application member, said first regulating portion being provided in said first frame at one end thereof with respect to the axial direction thereof;

a second regulating portion provided on said first frame at the other end thereof with respect to the axial direction and configured and positioned to engage with the main assembly with a larger gap than said first regulating portion to regulate the rotation of said first frame about said first portion to be positioned and said second portion to be positioned when said force receiving portion receives the force from the force application member;

a memory element configured to store information relating to said process cartridge, said memory element being provided at a leading end of said first frame with respect to a mounting direction in which said process cartridge is mounted to the main assembly of the apparatus and being provided at the other end of said first frame with respect to the axial direction;

a cartridge electrical contact provided at said one end of said first frame at the leading end thereof and configured and positioned to make an electrical connection with the main assembly electrical contact when said process cartridge is set in the main assembly of the apparatus, said cartridge electrical contact being effective to transmit information from said memory element to the main assembly of the apparatus when said cartridge electrical contact is electrically connected with the main assembly electrical contact;

a first recess provided in said first frame at said one end of said first frame and configured and positioned to position said cartridge electrical contact relative to the main assembly electrical contact when said process cartridge is being mounted to the main assembly of the apparatus, said first recess being engageable with the first projection when said process cartridge is being mounted to the main assembly of the apparatus; and a second recess provided in said first frame at said one end of said first frame and configured and positioned to position said cartridge electrical contact relative to the main assembly electrical contact when said process cartridge is being mounted to the main assembly of the apparatus, said second recess being engageable with the second projection when said process cartridge is being mounted to the main assembly of the apparatus, said second recess being disposed at a position across said cartridge electrical contact from said first recess, wherein when said process cartridge is set in the main assembly of the apparatus, said cartridge electrical contact moves integrally with the main assembly electrical contact by said first recess engaging with the first projection and said second recess engaging with the second projection, upon said first frame rotating about said first portion to be positioned and said second portion to be positioned by said force receiving portion receiving the force from the force application member.

2. A process cartridge according to claim 1, further comprising:

a drum driving force receiving portion configured and positioned to receive a driving force for rotating said electrophotographic photosensitive drum from the main assembly of the apparatus with said process cartridge is set in the main assembly of the apparatus, said drum driving force receiving portion being provided adjacent one end of said process cartridge; and a developing roller driving force receiving portion configured and positioned to receive a driving force for rotating said developing roller from the main assembly of the apparatus when said process cartridge is set in the main assembly of the apparatus, said developing roller driving force receiving portion being provided adjacent to said one end of said process cartridge.

3. A process cartridge according to claim 2, wherein said developing roller driving force receiving portion and said cartridge electrical contact are disposed inside said drum driving force receiving portion and said first regulating portion with respect to the axial direction of said first frame as seen from a downstream position with respect to the mounting direction.

4. An electrophotographic image forming apparatus for forming an image on a recording material, to which apparatus a process cartridge is detachably mountable, said apparatus comprising:

(a) a main assembly electrical contact;

(b) a first projection;

(c) a second projection;

(d) a movable supporting member supporting said main assembly electrical contact, said first projection and said second projection;

(e) a force application member;

(f) a first main assembly positioning portion; and (g) a second main assembly positioning portion, wherein the process cartridge comprises:

a first frame;

a second frame rotatably connected with the first frame;

an electrophotographic photosensitive drum provided in the first frame;

a first portion to be positioned, being positioned to the first main assembly positioning portion when the process cartridge is set in the main assembly of the apparatus, the first portion to be positioned projecting outwardly from the first frame substantially coaxially with an axis of the electrophotographic photosensitive drum at one end of the first frame with respect to the direction of the axis of the electrophotographic photosensitive drum;

a second portion to be positioned, being positioned to the second main assembly positioning portion when the process cartridge is set in the main assembly of said apparatus, the second portion to be positioned projecting outwardly from the first frame substantially coaxially with the axis of the electrophotographic photosensitive drum at the other end of the first frame with respect to the direction of the axis of the electrophotographic photosensitive drum;

a developing roller, contactable to the electrophotographic photosensitive drum provided in the second frame, and configured and positioned to develop an electrostatic latent image formed on the electrophotographic photosensitive drum;

an elastic member that applies an elastic force to the first frame and the second frame to contact the electrophotographic photosensitive drum and the developing roller to each other;

a force receiving portion, provided in the second frame, and configured and positioned to receive a force from said force application member to space the electrophotographic photosensitive drum and the developing roller from each other;

a first regulating portion configured and positioned to engage with the main assembly to regulate the rotation of the first frame about the first portion to be positioned and the second portion to be positioned when the force receiving portion receives the force from the force application member, the first regulating portion being provided in the first frame at one end thereof with respect to the axial direction thereof;

a second regulating portion provided on the first frame at the other end thereof with respect to the axial direction and configured and positioned to engage with the main assembly with a larger gap than the first regulating portion to regulate the rotation of the first frame about the first portion to be positioned and a second portion to be positioned when the force receiving portion receives said force from the force application member;

a memory element configured to store information relating to the process cartridge, the memory element being provided at a leading end of the first frame with respect to a mounting direction in which the process cartridge is mounted to the main assembly of said apparatus and being provided at the other end of the first frame with respect to the axial direction;

a cartridge electrical contact provided at the one end of the first frame at the leading end and configured and positioned to make an electrical connection with said main assembly electrical contact when the process cartridge is set in the main assembly of said apparatus, the cartridge electrical contact being effective to transmit information from the memory element to the main assembly of said apparatus when the cartridge electrical contact is electrically connected with said main assembly electrical contact;

a first recess provided in the first frame at the one end of the first frame and configured and positioned to position the cartridge electrical contact relative to said main assembly electrical contact when the process cartridge is being mounted to the main assembly of said apparatus, the first recess being engageable with said first projection when the process cartridge is being mounted to the main assembly of said apparatus; and a second recess provided in the first frame at the one end of the first frame and configured and positioned to position the cartridge electrical contact relative to said main assembly electrical contact when the process cartridge is being mounted to the main assembly of said apparatus, the second recess being engageable with said second projection when the process cartridge is being mounted to the main assembly of said apparatus, the second recess being disposed at a position across the cartridge electrical contact from the first recess, wherein when the process cartridge is set in the main assembly of said apparatus, the cartridge electrical contact moves integrally with said main assembly electrical contact by the first recess engaging with said first projection and the second recess engaging with said second projection, upon the first frame rotating about the first portion to be positioned and the second portion to be positioned by the force receiving portion receiving the force from said force application member.

5. An apparatus according to claim 4, further comprising a main assembly side regulating a portion provided in the main assembly and downstream of said supporting member with respect to a direction in which the process cartridge enters the main assembly of said apparatus, and when said supporting member is pushed by the process cartridge entering the main assembly of said apparatus, said supporting member contacts said main assembly side regulating portion to be regulated in a movement toward a rear side of the main assembly of said apparatus, and said supporting member is movable in a horizontal direction and in a direction perpendicular to the horizontal direction.

6. An apparatus according to claim 4 or 5, wherein said main assembly electrical contact includes a plurality of the electroconductive members retractable along the direction in which the process cartridge enters the main assembly of said apparatus.

7. An apparatus according to claim 4 or 5, wherein the process cartridge further comprises:

a drum driving force receiving portion configured and positioned to receive a driving force for rotating the electrophotographic photosensitive drum from the main assembly of said apparatus with the process cartridge is set in the main assembly of said apparatus, said drum driving force receiving portion being provided adjacent one end of the process cartridge; and a developing roller driving force receiving portion configured and positioned to receive a driving force for rotating the developing roller from the main assembly of said apparatus when the process cartridge is set in the main assembly of said apparatus, the developing roller driving force receiving portion being provided adjacent to the one end of the process cartridge.

8. An apparatus according to claim 7, wherein the developing roller driving force receiving portion and the cartridge electrical contact are disposed inside the drum driving force receiving portion and the first regulating portion with respect to the axial direction of the first frame as seen from a downstream position with respect to the mounting direction.

* * * * *